US010982610B2

(12) United States Patent
Ohtsuka et al.

(10) Patent No.: US 10,982,610 B2
(45) Date of Patent: Apr. 20, 2021

(54) ENGINE CONTROLLER

(71) Applicant: Mazda Motor Corporation, Hiroshima (JP)

(72) Inventors: Keisuke Ohtsuka, Hiroshima (JP); Kentaro Kimura, Hiroshima (JP); Takeatsu Ito, Hiroshima (JP); Tomokuni Kusunoki, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/811,160

(22) Filed: Mar. 6, 2020

(65) Prior Publication Data

US 2020/0355136 A1 Nov. 12, 2020

(30) Foreign Application Priority Data

May 8, 2019 (JP) ..... JP2019-088378

(51) Int. Cl.
*F02D 41/14* (2006.01)

(52) U.S. Cl.
CPC ..... *F02D 41/1447* (2013.01); *F02D 41/1475* (2013.01); *F02D 41/1439* (2013.01)

(58) Field of Classification Search
CPC ..... F02D 41/1439; F02D 41/1446; F02D 41/1447; F02D 41/1475; F02D 41/263; F02D 41/3005
See application file for complete search history.

(56) References Cited

U.S. PATENT DOCUMENTS

2003/0187568 A1* 10/2003 Yasui ..... G05D 23/1919 701/109
2004/0030485 A1* 2/2004 Yasui ..... F02D 41/1494 701/109
2009/0038595 A1* 2/2009 Arlt ..... G01K 7/42 123/676
2011/0231081 A1* 9/2011 Suzuki ..... F02D 13/0261 701/104
2015/0330326 A1* 11/2015 Shaver ..... F02D 13/0265 123/445

(Continued)

FOREIGN PATENT DOCUMENTS

JP 2017223138 A 12/2017

*Primary Examiner* — Sizo B Vilakazi
*Assistant Examiner* — Anthony L Bacon
(74) *Attorney, Agent, or Firm* — Alleman Hall Creasman & Tuttle LLP

(57) ABSTRACT

A controller for an engine estimates a temperature of the exhaust gas and controls the engine according to the estimated exhaust temperature. The controller changes the air-fuel ratio to a stoichiometric air-fuel ratio or leaner. The controller calculates the progress of combustion on the basis of signals of sensors, and estimates an exhaust temperature. In the case where the air-fuel ratio is the stoichiometric air-fuel ratio, the controller estimates the exhaust temperature on the basis of the progress of the combustion, the engine temperature, and a first relationship that is at least defined between the progress of the combustion and the exhaust temperature, . In the case where the air-fuel ratio is lean, the controller estimates the exhaust temperature on the basis of the progress of the combustion, the engine temperature, and a second relationship that differs from the first relationship.

8 Claims, 12 Drawing Sheets

(56) References Cited

U.S. PATENT DOCUMENTS

| | | | | |
|---|---|---|---|---|
| 2017/0191442 | A1* | 7/2017 | Polonowski | F02D 41/3076 |
| 2020/0332733 | A1* | 10/2020 | Gehrke | F02D 41/1497 |
| 2020/0332736 | A1* | 10/2020 | Gehrke | F01N 13/10 |

* cited by examiner

ENGINE CONTROLLER

TECHNICAL FIELD

A technique disclosed herein relates to an engine controller.

BACKGROUND ART

In Patent document 1, a technique of estimating a temperature of exhaust gas in a spark-ignition engine is described. More specifically, in this technique, an electronic control unit uses an exhaust temperature map, in which a relationship between each of an engine load and an engine speed and the temperature of the exhaust gas is defined, so as to estimate the temperature of the exhaust gas on the basis of an operation state of the engine. The temperature of the exhaust gas is affected by an ignition timing. Accordingly, in Patent document 1, it is described that the estimated temperature of the exhaust gas is corrected by a correction coefficient that is defined according to a difference between combustion gravity center at the time when the ignition timing is a maximum brake torque (MBT) and the combustion gravity center of actual combustion. The correction coefficient is set to be increased in the form of a quadratic curve as the difference in the combustion gravity center is increased.

In addition, in Patent document 1, it is described that the temperature of the exhaust gas is changed by an air-fuel ratio of an air-fuel mixture. More specifically, in Patent document 1, it is described that a function between a reference exhaust temperature and an air-fuel ratio is set and that a second correction coefficient is calculated according to this function.

PRIOR ART DOCUMENTS

Patent Documents

Patent document 1: JP 2017-223138A

SUMMARY OF THE INVENTION

Problem to be Solved by the Invention

The temperature of the exhaust gas is determined from a quantity of heat, which is acquired by subtracting a quantity of heat used for driving of the engine (that is, illustrated work) and a quantity of heat released to the engine (that is, cooling loss) from a quantity of heat generated by combustion in a cylinder.

Here, it is understood from the research by the present inventors and the like that the cooling loss was changed with a change in the air-fuel ratio of the air-fuel mixture. When it is desired to accurately estimate the temperature of the exhaust gas, unlike in Patent document 1, not only the air-fuel ratio of the air-fuel mixture but also the cooling loss has to be considered.

A technique disclosed herein estimates a temperature of exhaust gas accurately in an engine that changes an air-fuel ratio of air-fuel mixture.

Means for Solving the Problem

A technique disclosed herein relates to an engine controller for an engine. This controller includes: an exhaust passage which is connected to the engine and through which exhaust gas is discharged from inside of a cylinder of the engine; a sensor which outputs a signal corresponding to a combustion state in the cylinder; and a control unit to which the sensor is connected, which estimates a temperature of the exhaust gas on the basis of the signal of the sensor, and which controls the engine according to the estimated temperature of the exhaust gas.

The control unit changes an air-fuel ratio of an air-fuel mixture in the cylinder to a stoichiometric air-fuel ratio or a leaner air-fuel ratio than the stoichiometric air-fuel ratio according to an operation state of the engine.

The control unit includes a processor configured to execute a calculation module that calculates progress of combustion as a crank angle at the time when the combustion in the cylinder is progressed to a particular extent on the basis of the signal of the sensor; and an estimation module that estimates the temperature of the exhaust gas on the basis of the progress of the combustion calculated by the calculation module, the air-fuel ratio of the air-fuel mixture, and a temperature of the engine.

In a case where the air-fuel ratio of the air-fuel mixture is the stoichiometric air-fuel ratio, the estimation module estimates the temperature of the exhaust gas on the basis of the progress of the combustion, the temperature of the engine, and a first relationship that is at least defined between the progress of the combustion and the temperature of the exhaust gas, and in a case where the air-fuel ratio of the air-fuel mixture is leaner than the stoichiometric air-fuel ratio, the estimation module estimates the temperature of the exhaust gas on the basis of the progress of the combustion, the temperature of the engine, and a second relationship that differs from the first relationship and is at least defined between the progress of the combustion and the temperature of the exhaust gas.

The engine controller with this configuration estimates the temperature of the exhaust gas on the basis of the progress of the combustion. More specifically, the calculation module of the control unit calculates the progress of the combustion that corresponds to the crank angle at the time when the combustion in the cylinder is progressed to the particular extent on the basis of the signal of the sensor. The sensor outputs the signal corresponding to the combustion state in the cylinder. The sensor may be an in-cylinder pressure sensor that outputs a signal corresponding to an in-cylinder pressure. The control unit can accurately comprehend the combustion state in the cylinder on the basis of the signal of the in-cylinder pressure sensor.

The progress of the combustion is the crank angle at the time when the combustion is progressed to the particular extent. Thus, the progress of the combustion can be used as a parameter representing the combustion state. The crank angle at which a mass combustion rate acquires a particular value, for example, the crank angle at which the mass combustion rate is 50% (that is, mass fraction burned 50: mfb50) may be used as the progress of the combustion. The term "mfb50" means the crank angle at which 50% of a total injection amount of the fuel is burned. However, the progress of the combustion is not limited to mfb50. As long as there is a correlation between the progress of the combustion and the temperature of the exhaust gas, any value such as mfb10 or mfb90 can be used as the progress of the combustion.

The control unit changes the air-fuel ratio of the air-fuel mixture according to the operation state of the engine. More specifically, the control unit changes the air-fuel ratio of the air-fuel mixture to the stoichiometric air-fuel ratio or the leaner air-fuel ratio than the stoichiometric air-fuel ratio.

The estimation module of the control unit estimates the temperature of the exhaust gas on the basis of the progress of the combustion, which is calculated by the calculation module, the air-fuel ratio of the air-fuel mixture, and the temperature of the engine. The temperature of the engine may be a temperature of an engine coolant, for example. In the case where the air-fuel ratio of the air-fuel mixture is lean, thermal efficiency of the engine is relatively high, which reduces an amount of the fuel supply to the cylinder. As a result, the temperature inside the cylinder during the combustion is lower than that in the case where the air-fuel ratio of the air-fuel mixture is the stoichiometric air-fuel ratio. In addition, cooling loss is less than that in the case where the air-fuel ratio of the air-fuel mixture is the stoichiometric air-fuel ratio. That is, when the air-fuel ratio of the air-fuel mixture is changed, the amount of the cooling loss is also changed. Thus, the temperature of the exhaust gas is also changed by the change in the amount of the cooling loss. A relationship between the progress of the combustion and the temperature of the exhaust gas is changed with a change in the air-fuel ratio of the air-fuel mixture. In addition, when the temperature of the engine is changed, the amount of the cooling loss is changed. Thus, the temperature of the exhaust gas is also changed.

The estimation module estimates the temperature of the exhaust gas on the basis of the first relationship, which is at least defined between the progress of the combustion and the temperature of the exhaust gas, the progress of the combustion, and the temperature of the engine in the case where the air-fuel ratio of the air-fuel mixture is the stoichiometric air-fuel ratio. The estimation module estimates the temperature of the exhaust gas on the basis of the second relationship, which is at least defined between the progress of the combustion and the temperature of the exhaust gas, the progress of the combustion, and the temperature of the engine in the case where the air-fuel ratio of the air-fuel mixture is leaner than the stoichiometric air-fuel ratio. The estimation module switches between the first relationship and the second relationship according to the case where the air-fuel ratio of the air-fuel mixture is the stoichiometric air-fuel ratio or leaner than the stoichiometric air-fuel ratio. In this way, the estimation module can accurately estimate the temperature of the exhaust gas in consideration of the temperature of the engine both in the case where the air-fuel ratio of the air-fuel mixture is the stoichiometric air-fuel ratio and in the case where the air-fuel ratio of the air-fuel mixture is leaner than the stoichiometric air-fuel ratio.

The estimation module may estimate the temperature of the exhaust gas from the progress of the combustion on the basis of the relationship between the progress of the combustion and the temperature of the exhaust gas, and may correct the estimated temperature of the exhaust gas according to the temperature of the engine. The estimation module may change the correction amount of the temperature of the exhaust gas according to the air-fuel ratio of the air-fuel mixture.

In this way, the estimation module can change the correction amount according to the cooling loss, which is changed by the change in the air-fuel ratio of the air-fuel mixture. The estimation module can accurately estimate the temperature of the exhaust gas on the basis of the progress of the combustion, the air-fuel ratio of the air-fuel mixture, and the temperature of the engine.

In the case where the air-fuel ratio of the air-fuel mixture is the stoichiometric air-fuel ratio, the estimation module may increase the correction amount of the temperature of the exhaust gas to be larger than in the case where the air-fuel ratio of the air-fuel mixture is leaner than the stoichiometric air-fuel ratio.

As described above, in the case where the air-fuel ratio of the air-fuel mixture is lean, the amount of the cooling loss is relatively small. On the contrary, in the case where the air-fuel ratio of the air-fuel mixture is the stoichiometric air-fuel ratio, the amount of the cooling loss is relatively large.

Accordingly, in the case where the air-fuel ratio of the air-fuel mixture is the stoichiometric air-fuel ratio, the estimation module increases the correction amount of the temperature of the exhaust gas. In the case where the air-fuel ratio of the air-fuel mixture is lean, the correction amount is reduced. In this way, the estimation module can accurately estimate the temperature of the exhaust gas in consideration of the relationship between the air-fuel ratio of the air-fuel mixture and the cooling loss.

The estimation module may make a correction to reduce the estimated temperature of the exhaust gas as the temperature of the engine is reduced in a case where the temperature of the engine is equal to or lower than a specified temperature, and may make a correction to increase the estimated temperature of the exhaust gas as the temperature of the engine is increased in a case where the temperature of the engine exceeds the specified temperature.

That is, each of the first relationship and the second relationship may be set as a relationship between the progress of the combustion and the temperature of the exhaust gas that is defined when the temperature of the engine is the specified temperature. The temperature of exhaust gas, which is estimated on the basis of the above relationship and the progress of the combustion, corresponds to the temperature of the exhaust gas in the case where the temperature of the engine is the specified temperature. In the case where the temperature of the engine is equal to or lower than the specified temperature, the amount of the cooling loss is increased as the temperature of the engine is reduced. Thus, the estimation module makes the correction to reduce the estimated temperature of the exhaust gas. In this way, the estimation module can accurately estimate the temperature of the exhaust gas. Meanwhile, in the case where the temperature of the engine exceeds the specified temperature, the cooling loss is reduced as the temperature of the engine is increased. Thus, the estimation module makes the correction to increase the estimated temperature of the exhaust gas. In this way, the estimation module can accurately estimate the temperature of the exhaust gas.

The control unit may switch between a first combustion mode, in which the air-fuel mixture in the cylinder is forcibly ignited according to the operation state of the engine, so as to burn the air-fuel mixture by flame propagation, and a second combustion mode, in which the air-fuel mixture in the cylinder is forcibly ignited, so as to burn some of the air-fuel mixture by self-ignition.

In the second combustion mode, the control unit may change the air-fuel ratio of the air-fuel mixture according to the operation state of the engine.

The present applicant proposes spark controlled compression ignition (SPCCI) combustion in which spark ignition (SI) combustion and compression ignition (CI) combustion are combined. The SI combustion is combustion that is initiated at the time when the air-fuel mixture in the cylinder is forcibly ignited and that is associated with flame propagation. The CI combustion is combustion that is initiated at the time when the air-fuel mixture in the cylinder is self-ignited. The SPCCI combustion is in a mode in which, when the air-fuel mixture in the cylinder is forcibly ignited to initiate the combustion by the flame propagation, unburned air-fuel mixture in the cylinder is burned by the self-ignition due to a pressure increase caused by heat generation and the flame propagation in the SI combustion.

The first combustion mode corresponds to a mode in which the SI combustion is performed. The second combustion mode corresponds to a mode in which the SPCCI combustion is performed. In the SI combustion, in the case where the air-fuel ratio of the air-fuel mixture is leaner than the stoichiometric air-fuel ratio, combustion stability is possibly degraded. Meanwhile, in the SPCCI combustion, some of the air-fuel mixture is burned by the self-ignition. Thus, even in the case where the air-fuel ratio of the air-fuel mixture is leaner than the stoichiometric air-fuel ratio, it is possible to stably burn the air-fuel mixture. In the second combustion mode, the air-fuel ratio of the air-fuel mixture is changed according to the operation state of the engine. In this way, the engine can simultaneously secure combustion stability and improve thermal efficiency.

In a case where the temperature of the exhaust gas is higher than a reference temperature, the control unit may increase an amount of the fuel supplied to the cylinder to be larger than in a case where the temperature of the exhaust gas is equal to or lower than the reference temperature.

When the amount of the fuel supplied to the cylinder is increased, due to latent heat of the fuel, the amount of which is increased, the temperature of the exhaust gas discharged from the cylinder is reduced. By reducing the temperature of the exhaust gas to be lower than the reference temperature, it is possible to secure reliability of a catalytic device provided in the exhaust passage of the engine, for example. The performance of the catalytic device can be maintained in a high state. Thus, the engine can discharge purified gas.

In a case where the temperature of the exhaust gas is higher than a reference temperature, the control unit may reduce a temperature of a coolant supplied to the engine to be lower than in a case where the temperature of the exhaust gas is equal to or lower than the reference temperature.

When the temperature of the coolant supplied to the engine is reduced, the amount of the cooling loss is increased. As a result, the temperature of the exhaust gas discharged from the cylinder is reduced. Thus, similar to the above, it is possible to secure the reliability of the catalytic device.

In the case where the temperature of the exhaust gas is higher than a reference temperature, the control unit may increase a flow rate of the coolant supplied to the engine to be larger than in a case where the temperature of the exhaust gas is equal to or lower than the reference temperature.

When the flow rate of the coolant supplied to the engine is increased, the amount of the cooling loss is increased. As a result, the temperature of the exhaust gas discharged from the cylinder is reduced. Thus, similar to the above, it is possible to secure the reliability of the catalytic device.

Advantage of the Invention

As it has been described so far, the engine controller can accurately estimate the temperature of the exhaust gas in the engine that changes the air-fuel ratio of the air-fuel mixture.

MODES FOR CARRYING OUT THE INVENTION

A detailed description will hereinafter be made on an embodiment of an engine controller with reference to the drawings. The following description exemplifies the engine, an engine system, and the engine controller.

Figure 1:
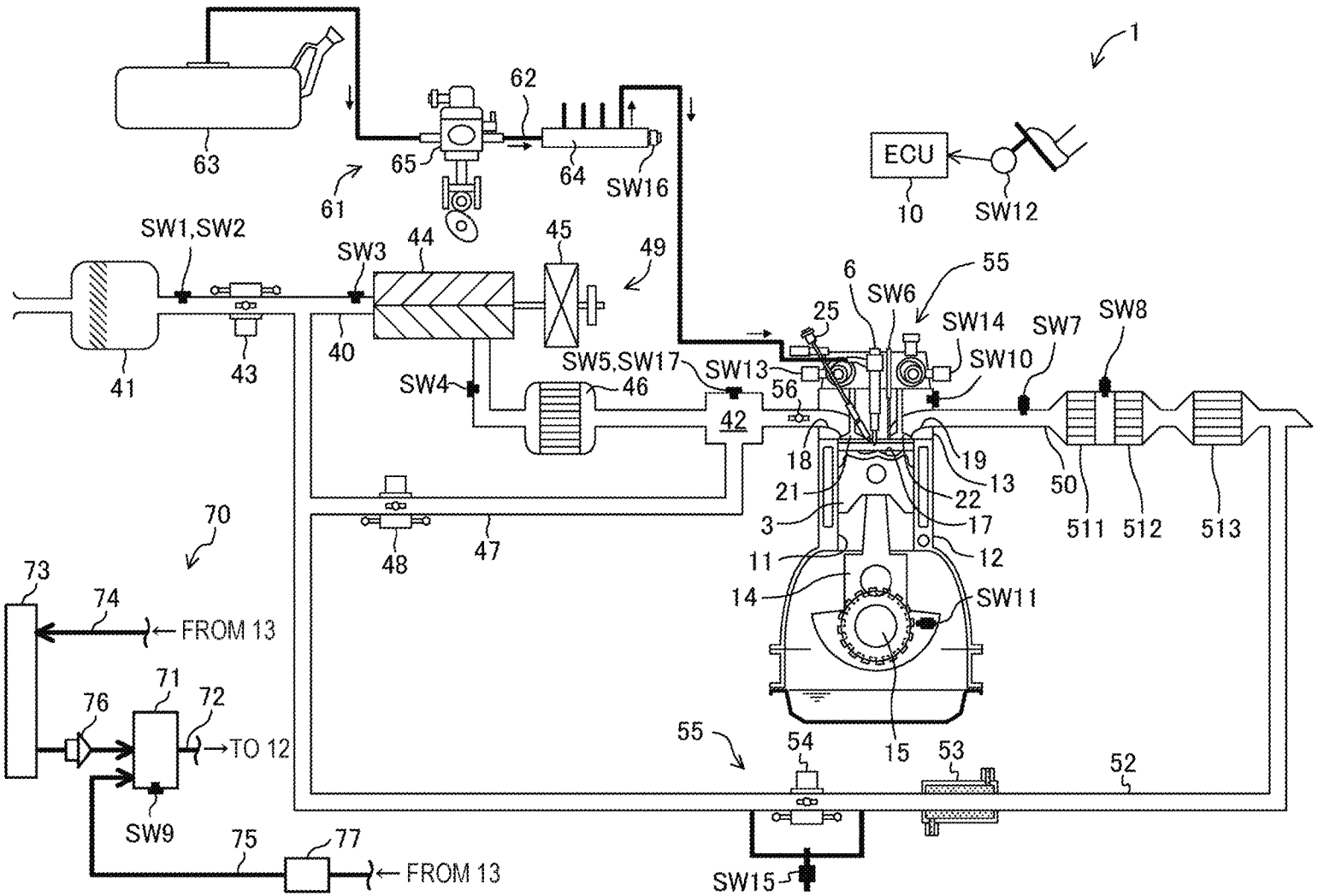
FIG. 1 is a view exemplifying a configuration of an engine.
Figure 2:
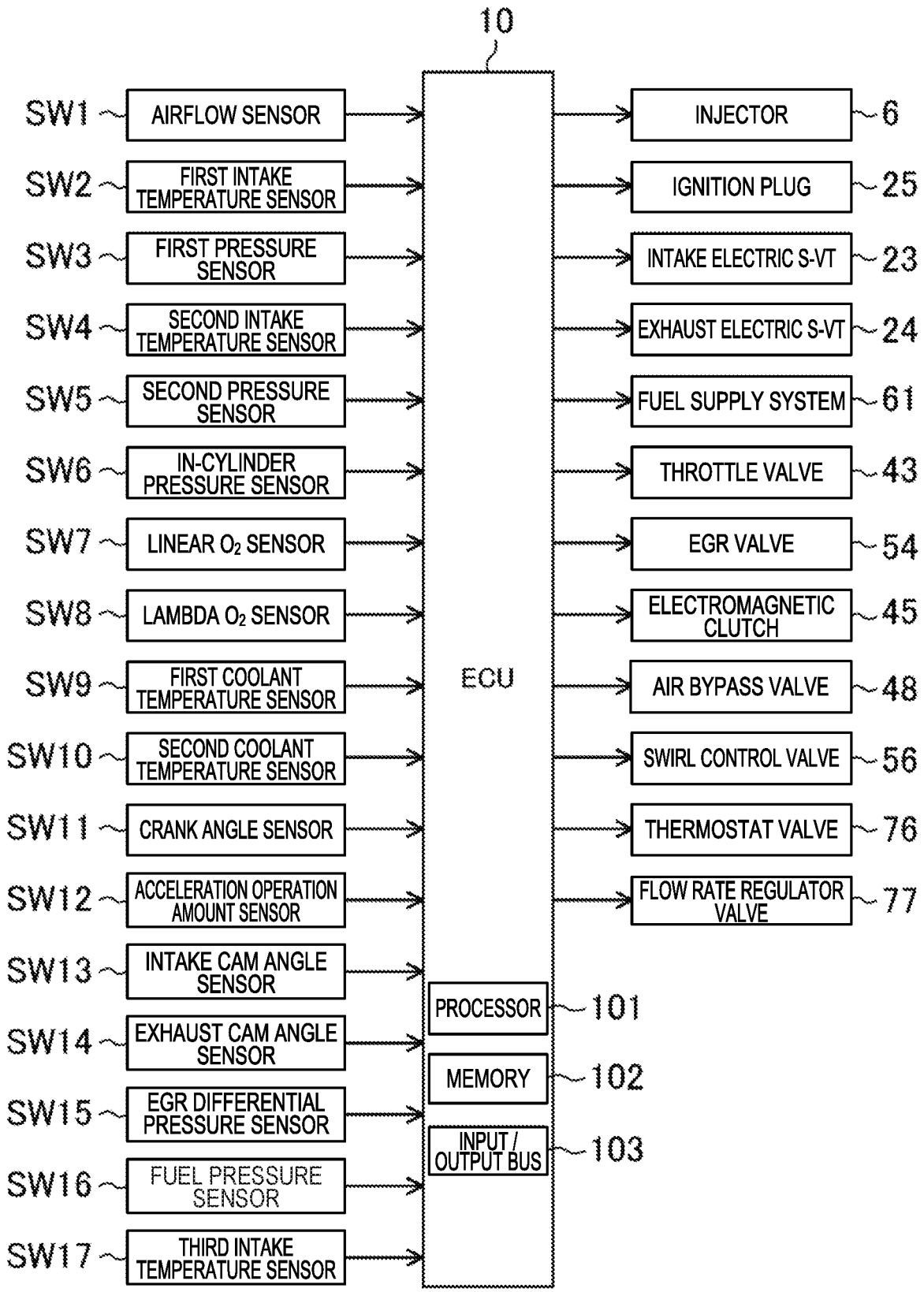
FIG. 2 is a block diagram exemplifying a configuration of an engine controller.

FIG. 1 is a view exemplifying a configuration of the engine system. FIG. 2 is a block diagram exemplifying a configuration of the engine controller.

An engine 1 is a four-stroke engine that is operated by repeating an intake stroke, a compression stroke, a power stroke, and an exhaust stroke in a combustion chamber 17. The engine 1 is mounted on a four-wheeled automobile. The automobile travels by operating the engine 1. As the engine in this configuration example, the engine 1 uses gasoline as fuel. The fuel only has to be liquid fuel that at least includes gasoline. The fuel may be gasoline that contains bioethanol or the like, for example.

(Engine Configuration)

The engine 1 includes a cylinder block 12 and a cylinder head 13 placed thereon. A plurality of cylinders 11 are formed in the cylinder block 12. FIG. 1 illustrates only one of the cylinders 11. The engine 1 is a multi-cylinder engine.

A piston 3 is slidably inserted in each of the cylinders 11. The piston 3 is coupled to a crankshaft 15 via a connecting rod 14. With the cylinder 11 and the cylinder head 13, the piston 3 defines the combustion chamber 17. The term "combustion chamber" may be used in a broad sense. That is, the "combustion chamber" may mean the space defined by the piston 3, the cylinder 11, and the cylinder head 13 regardless of a position of the piston 3.

A geometric compression ratio of the engine 1 is set to be equal to or higher than 10 and equal to or lower than 30. As will be described later, in a part of an operating range, the engine 1 performs SPCCI combustion in which spark ignition (SI) combustion and compression ignition (CI) combustion are combined. In the SPCCI combustion, the CI combustion is controlled using heat and a pressure increase generated by the SI combustion. The engine 1 is of a compression-ignition type. In this engine 1, a temperature of the combustion chamber 17 at the time when the piston 3 reaches compression top dead center (that is, a compression end temperature) does not have to be increased. The geometric compression ratio of the engine 1 can be set relatively low. A reduction in the geometric compression ratio is advantageous in terms of a reduction in cooling loss and a reduction in mechanical loss. As an engine having a regular specification (using low octane fuel, an octane rating of which is approximately 91), the engine 1 may have the geometric compression ratio of 14 to 17. As an engine having a high-octane specification (using high octane fuel, the octane rating of which is approximately 96), the engine 1 may have the geometric compression ratio of 15 to 18.

In the cylinder head 13, an intake port 18 is formed for each of the cylinders 11. Although not illustrated, the intake port 18 has a first intake port and a second intake port. The intake port 18 communicates with the combustion chamber 17. Although detailed illustration is not provided, the intake port 18 is a so-called tumble port. That is, the intake port 18 has such a shape that a tumble flow is generated in the combustion chamber 17.

An intake valve 21 is disposed in the intake port 18. The intake valve 21 is opened/closed at a position between the combustion chamber 17 and the intake port 18. The intake valve 21 is opened/closed at a specified timing by a valve mechanism. The valve mechanism is preferably a variable valve mechanism that varies valve timing and/or valve lifting. In this configuration example, as illustrated in FIG. 2, the variable valve mechanism includes an intake electric sequential-valve timing (S-VT) 23. The intake electric S-VT 23 continuously varies a rotation phase of an intake camshaft within a specified angle range. The intake valve mechanism may include a hydraulic S-VT instead of the electric S-VT.

In the cylinder head 13, an exhaust port 19 is also formed for each of the cylinders 11. The exhaust port 19 also has a first exhaust port and a second exhaust port. The exhaust port 19 communicates with the combustion chamber 17.

An exhaust valve 22 is disposed in the exhaust port 19. The exhaust valve 22 is opened/closed at a position between the combustion chamber 17 and the exhaust port 19. The exhaust valve 22 is opened/closed at a specified timing by a valve mechanism. This valve mechanism is preferably a variable valve mechanism that varies valve timing and/or valve lifting. In this embodiment, as illustrated in FIG. 2, the variable valve mechanism includes an exhaust electric S-VT 24. The exhaust electric S-VT 24 continuously varies a rotation phase of an exhaust camshaft within a specified angle range. The exhaust valve mechanism may include a hydraulic S-VT instead of the electric S-VT.

The intake electric S-VT 23 and the exhaust electric S-VT 24 regulate duration of an overlap period in which both of the intake valve 21 and the exhaust valve 22 are opened. In the case where the duration of the overlap period is extended, residual gas in the combustion chamber 17 can be eliminated. In addition, when the duration of the overlap period is regulated, internal exhaust gas recirculation (EGR) gas can be introduced into the combustion chamber 17. The intake electric S-VT 23 and the exhaust electric S-VT 24 constitute an internal EGR system. Here, the internal EGR system is not limited to one constructed of the S-VTs.

For each of the cylinders 11, an injector 6 is attached to the cylinder head 13. The injector 6 directly injects the fuel into the combustion chamber 17. The injector 6 is an example of a fuel supplier. Although detailed illustration is not provided, the injector 6 is formed of a fuel injection valve of a multiple injection-port type that has multiple injection ports. The injector 6 is attached to a central portion of the combustion chamber 17 and injects the fuel such that a fuel spray spreads radially from a center of the combustion chamber 17.

A fuel supply system 61 is connected to the injector 6. The fuel supply system 61 includes: a fuel tank 63 configured to store the fuel; and a fuel supply passage 62 that couples the fuel tank 63 and the injector 6 to each other. A fuel pump 65 and a common rail 64 are provided in the fuel supply passage 62. The fuel pump 65 pumps the fuel to the common rail 64. In the engine 1 of this configuration example, the fuel pump 65 is a plunger pump that is driven by the crankshaft 15. The common rail 64 stores the fuel, which is pumped from the fuel pump 65, at a high fuel pressure. When the injector 6 is opened, the fuel stored in the common rail 64 is injected into the combustion chamber 17 from the injection ports of the injector 6. The fuel supply system 61 can supply the high-pressure fuel at 30 MPa or higher to the injector 6. The pressure of the fuel to be supplied to the injector 6 may vary according to an operation state of the engine 1. A configuration of the fuel supply system 61 is not limited to the configuration described above.

For each of the cylinders 11, an ignition plug 25 is attached to the cylinder head 13. The ignition plug 25 forcibly ignites an air-fuel mixture in the combustion chamber 17. Although detailed illustration is not provided, an electrode of the ignition plug 25 faces the inside of the combustion chamber 17 and is located near a ceiling surface of the combustion chamber 17.

An intake passage 40 is connected to one side surface of the engine 1. The intake passage 40 communicates with the intake port 18 for each of the cylinders 11. Gas to be introduced into the combustion chamber 17 flows through the intake passage 40. An air cleaner 41 is disposed in an upstream end portion of the intake passage 40. The air cleaner 41 filters fresh air. A surge tank 42 is disposed near a downstream end of the intake passage 40. A portion of the intake passage 40 on a downstream side of the surge tank 42 constitutes an independent passage that is branched for each of the cylinders 11. A downstream end of the independent passage is connected to the intake port 18 for each of the cylinders 11.

A throttle valve 43 is disposed between the air cleaner 41 and the surge tank 42 in the intake passage 40. The throttle valve 43 regulates an opening degree thereof so as to regulate an introduction amount of the fresh air into the combustion chamber 17.

In addition, in the intake passage 40, a supercharger 44 is disposed on a downstream side of the throttle valve 43. The supercharger 44 supercharges the gas to be introduced into the combustion chamber 17. In the engine 1 of this configuration example, the supercharger 44 is a mechanical supercharger that is driven by the engine 1. The mechanical supercharger 44 may be of a root type, a Lysholm type, a vane type, or a centrifugal type.

An electromagnetic clutch 45 is interposed between the supercharger 44 and the engine 1. At a position between the supercharger 44 and the engine 1, the electromagnetic clutch 45 transmits drive power from the engine 1 to the supercharger 44 and blocks the transmission of the drive power. When an engine control unit (ECU) 10 switches between engagement and disengagement of the electromagnetic clutch 45, the supercharger 44 is switched between ON and OFF.

In the intake passage 40, an intercooler 46 is disposed on a downstream side of the supercharger 44. The intercooler 46 cools the gas that has been compressed by the supercharger 44. The intercooler 46 may be of a water-cooling type or an oil-cooling type, for example.

A bypass passage 47 is connected to the intake passage 40. The bypass passage 47 connects a portion of the intake passage 40 on an upstream side of the supercharger 44 and a portion of the intake passage 40 on a downstream side of the intercooler 46, so as to bypass the supercharger 44 and the intercooler 46. An air bypass valve 48 is disposed in the bypass passage 47. The air bypass valve 48 regulates a flow rate of the gas that flows through the bypass passage 47.

When the supercharger 44 is turned OFF (that is, when the electromagnetic clutch 45 is disengaged), the ECU 10 fully opens the air bypass valve 48. The gas that flows through the intake passage 40 bypasses the supercharger 44 and is introduced into the combustion chamber 17 of the engine 1. The engine 1 is operated in a non-supercharged state, that is, a naturally aspired state.

When the supercharger 44 is turned ON, the engine 1 is operated in a supercharged state. When the supercharger 44 is turned ON (that is, when the electromagnetic clutch 45 is engaged), the ECU 10 regulates an opening degree of the air bypass valve 48. Some of the gas that has flowed through the supercharger 44 flows through the bypass passage 47 and flows back to the upstream side of the supercharger 44. When the ECU 10 regulates the opening degree of the air bypass valve 48, a boost pressure of the gas to be introduced into the combustion chamber 17 varies. Here, a supercharged period may be defined as a period in which a pressure in the surge tank 42 exceeds the atmospheric pressure, and a non-supercharged period may be defined as a period in which the pressure in the surge tank 42 becomes equal to or lower than the atmospheric pressure.

In the engine 1 of this configuration example, a supercharging system 49 is constructed of the supercharger 44, the bypass passage 47, and the air bypass valve 48. For example, the supercharger 44 is turned OFF in a low-load, low-speed operating range and is turned ON in the operating range other than the above.

The engine 1 includes a swirl generation part, in which a swirl flow is generated, in the combustion chamber 17. The swirl generation part includes a swirl control valve 56 that is attached to the intake passage 40. Although detailed illustration is not provided, the swirl control valve 56 is disposed in a secondary passage among a primary passage connected to the first intake port of the two intake ports 18 and the secondary passage connected to the second intake port. The swirl control valve 56 is an opening-degree regulation valve that can reduce a cross section of the secondary passage. When the opening degree of the swirl control valve 56 is small, an intake flow rate from the first intake port into the combustion chamber 17 is relatively large while the intake flow rate from the second intake port into the combustion chamber 17 is relatively small. As a result, the swirl flow in the combustion chamber 17 is intensified. Meanwhile, when the opening degree of the swirl control valve 56 is large, the intake flow rate from the first intake port into the combustion chamber 17 and the intake flow rate from the second intake port into the combustion chamber 17 become substantially the same. As a result, the swirl flow in the combustion chamber 17 is weakened. When the swirl control valve 56 is fully opened, the swirl flow is not generated.

An exhaust passage 50 is connected to another side surface of the engine 1. The exhaust passage 50 communicates with the exhaust port 19 for each of the cylinders 11. The exhaust passage 50 is a passage through which exhaust gas discharged from the combustion chamber 17 flows. Although detailed illustration is not provided, an upstream portion of the exhaust passage 50 constitutes an independent passage that is branched for each of the cylinders 11. An upstream end of the independent passage is connected to the exhaust port 19 for each of the cylinders 11.

An exhaust gas aftertreatment system having a plurality of catalytic converters is disposed in the exhaust passage 50. Although not illustrated, an upstream catalytic converter is disposed in an engine room. The upstream catalytic converter has a three-way catalyst 511 and a gasoline particulate filter (GPF) 512. A downstream catalytic converter is also disposed in the engine room. The downstream catalytic converter has a three-way catalyst 513. The configuration of the exhaust gas aftertreatment system is not limited to the illustrated example of the configuration. For example, the GPF 512 may not be provided. In addition, the catalytic converter is not limited to one having the three-way catalysts. Furthermore, an arrangement order of the three-way catalysts and the GPF may appropriately be changed.

An EGR passage 52 that constitutes an external EGR system is connected between the intake passage 40 and the exhaust passage 50. The EGR passage 52 is a passage through which the exhaust gas is partially recirculated into the intake passage 40. An upstream end of the EGR passage 52 is connected to a portion of the exhaust passage 50 on a downstream side of the downstream catalytic converter. A downstream end of the EGR passage 52 is connected to the portion of the intake passage 40 on the upstream side of the supercharger 44.

An EGR cooler 53 of a water-cooling type is disposed in the EGR passage 52. The EGR cooler 53 cools the exhaust gas. An EGR valve 54 is also disposed in the EGR passage 52. The EGR valve 54 regulates a flow rate of the exhaust gas flowing through the EGR passage 52. When an opening degree of the EGR valve 54 is regulated, a recirculation amount of the cooled exhaust gas, that is, external EGR gas can be regulated.

In the engine 1 of this configuration example, an EGR system 55 is constructed of the external EGR system and the internal EGR system. The external EGR system can supply the exhaust gas, the temperature of which is lower than that in the internal EGR system, to the combustion chamber 17.

The engine 1 has a cooling system 70. The cooling system 70 includes: a pump 71 that supplies a coolant; an inlet passage 72 through which the coolant flows from the pump 71 into the cylinder block 12 of the engine 1; a radiator passage 74 through which the coolant, which has flowed through a coolant passage in the engine 1, flows from the cylinder head 13 of the engine 1 into the pump 71 via a radiator 73; and a radiator-bypass passage 75 through which the coolant, which has flowed through the coolant passage in the engine 1, bypasses the radiator 73 and flows into the pump 71.

The pump 71 is a mechanical pump that is driven in an interlocking manner with the crankshaft 15. A discharge port of the pump 71 is connected to the inlet passage 72. The pump 71 is provided with a first coolant temperature sensor SW9 that detects a temperature of the coolant to be discharged to the inlet passage 72. A discharge amount of the coolant from the pump 71 fluctuates according to an engine speed and a recirculation amount of the coolant into the pump 71. The first coolant temperature sensor SW9 may be arranged in a manner to detect the temperature of the coolant flowing through the inlet passage 72.

The inlet passage 72 communicates between the discharge port of the pump 71 and an inlet of the coolant passage in the cylinder block 12.

The radiator passage 74 is connected to the coolant passage in the cylinder head 13. In the radiator passage 74, a thermostat valve 76 is arranged between the radiator 73 and the pump 71. The thermostat valve 76 is formed of an electric thermostat valve. More specifically, the thermostat valve 76 is a general thermostat valve having a heating wire therein. The thermostat valve 76 is configured to be opened according to the temperature of the coolant when the temperature of the coolant is equal to or higher than a specified coolant temperature during a de-energized period. However, with energization of the heating wire, the thermostat valve 76 can be opened even when the temperature of the coolant is lower than the specified coolant temperature. That is, in the de-energized period, the thermostat valve 76 is opened at the specified coolant temperature, and thus, the temperature of the coolant in the radiator passage 74 can be brought closer to the specified coolant temperature. Meanwhile, in the energized period, the thermostat valve 76 is opened at a desired coolant temperature that is lower than the specified coolant temperature. Accordingly, the temperature of the coolant in the radiator passage 74 can be brought to the desired coolant temperature.

Similar to the radiator passage 74, the radiator-bypass passage 75 is connected to the coolant passage in the cylinder head 13. A flow rate regulator valve 77 is arranged in an intermediate portion of the radiator-bypass passage 75. The flow rate regulator valve 77 is an on/off-type valve that can be switched between an open state at a specified opening degree and a closed state of being fully closed. The flow rate regulator valve 77 regulates a period in the open state and a period in the closed state, more specifically, a ratio between the open state and the closed state per unit time (hereinafter referred to as a duty ratio), so as to regulate the flow rate of the coolant flowing through the radiator-bypass passage 75.

(Configuration of Engine Controller)

The engine controller includes the ECU 10. The ECU 10 is a controller that has a well-known microcomputer as a base, and, as illustrated in FIG. 2, includes a processor (e.g., a central processing unit (CPU)) 101 that executed programs, memory 102 constructed of random access memory (RAM) or read only memory (ROM), for example, to store a program and data, and an input/output bus 103 that inputs/outputs an electric signal. The ECU 10 is an example of a control unit.

As illustrated in FIG. 1 and FIG. 2, various sensors SW1 to SW17 are connected to the ECU 10. Each of the sensors SW1 to SW17 outputs a signal to the ECU 10. The following sensors are included.

Airflow sensor SW1: arranged on a downstream side of the air cleaner 41 in the intake passage 40 to measure the flow rate of the fresh air flowing through the intake passage 40.

First intake temperature sensor SW2: arranged on the downstream side of the air cleaner 41 in the intake passage 40 so as to measure a temperature of the fresh air flowing through the intake passage 40.

First pressure sensor SW3: arranged on a downstream side of a position, to which the EGR passage 52 is connected, in the intake passage 40 and on the upstream side of the supercharger 44 so as to measure a pressure of the gas flowing into the supercharger 44.

Second intake temperature sensor SW4: arranged on the downstream side of the supercharger 44 and on the upstream side of a position, to which the bypass passage 47 is connected, in the intake passage 40 so as to measure the temperature of the gas that has flowed out of the supercharger 44.

Second pressure sensor SW5: attached to the surge tank 42 to measure the pressure of the gas on the downstream side of the supercharger 44.

In-cylinder pressure sensor SW6: attached to the cylinder head 13 in a manner to correspond to each of the cylinders 11 so as to measure a pressure in each of the combustion chambers 17.

Linear $O_2$ sensor SW7: arranged on an upstream side of the upstream catalytic converter in the exhaust passage 50 so as to measure concentration of oxygen in the exhaust gas.

Lambda $O_2$ sensor SW8: arranged on a downstream side of the three-way catalyst 511 in the upstream catalytic converter so as to measure the concentration of oxygen in the exhaust gas.

First coolant temperature sensor SW9: as described above, attached to the pump 71 to detect the temperature of the coolant flowing into the cylinder block 12.

Second coolant temperature sensor SW10: attached to the engine 1 to measure the temperature of the coolant immediately after heat exchange with the engine 1.

Crank angle sensor SW11: attached to the engine 1 to measure a rotation angle of the crankshaft 15.

Accelerator operation amount sensor SW12: attached to an accelerator pedal mechanism to measure an accelerator operation amount that corresponds to an operation amount of an accelerator pedal.

Intake cam angle sensor SW13: attached to the engine 1 to measure a rotation angle of the intake camshaft.

Exhaust cam angle sensor SW14: attached to the engine 1 to measure a rotation angle of the exhaust camshaft.

EGR differential pressure sensor SW15: arranged in the EGR passage 52 to measure a differential pressure between the upstream side and the downstream side of the EGR valve 54.

Fuel pressure sensor SW16: attached to the common rail 64 in the fuel supply system 61 to measure the pressure of the fuel to be supplied to the injector 6.

Third intake temperature sensor SW17: attached to the surge tank 42 to measure the temperature of the gas in the surge tank 42, in other words, the temperature of the intake air to be introduced into the combustion chamber 17.

On the basis of signals from these sensors SW1 to SW17, the ECU 10 determines the operation state of the engine 1 and calculates a control amount of each of the devices according to a predetermined control logic. The control logic is stored in the memory 102. The control logic includes calculation of a target amount and/or the control amount by using an operation map stored in the memory 102.

The ECU 10 outputs an electric signal related to the calculated control amount to the injector 6, the ignition plug 25, the intake electric S-VT 23, the exhaust electric S-VT 24, the fuel supply system 61, the throttle valve 43, the EGR valve 54, the electromagnetic clutch 45 of the supercharger 44, the air bypass valve 48, the swirl control valve 56, the thermostat valve 76, and the flow rate regulator valve 77.

For example, based on the signal of the accelerator operation amount sensor SW12 and the operation map, the ECU 10 sets target torque of the engine 1 and determines a target boost pressure. Then, based on the target boost pressure and the differential pressure before and after the supercharger 44 acquired from the signals of the first pressure sensor SW3 and the second pressure sensor SW5, the ECU 10 executes a feedback control for regulating the opening degree of the air bypass valve 48, so as to bring the boost pressure to the target boost pressure.

In addition, the ECU 10 sets a target EGR rate on the basis of the operation state of the engine 1 and the operation map. The EGR rate is a rate of the EGR gas to the whole gas in the combustion chamber 17. The ECU 10 determines a target EGR gas amount on the basis of an intake air amount that is based on the target EGR rate and the signal of the accelerator operation amount sensor SW12, and executes the feedback control for regulating the opening degree of the EGR valve 54 on the basis of the differential pressure before and after the EGR valve 54 acquired from the signal of the EGR differential pressure sensor SW15, so as to set an external EGR gas amount to be introduced into the combustion chamber 17 to the target EGR gas amount.

Furthermore, the ECU 10 executes an air-fuel ratio feedback control in the case where a specified control condition is established. More specifically, the ECU 10 regulates a fuel injection amount of the injector 6 such that the air-fuel ratio of the air-fuel mixture acquires a desired value on the basis of the concentration of oxygen in the exhaust gas measured by the linear $O_2$ sensor SW7 and the lambda $O_2$ sensor SW8.

(Concept of SPCCI Combustion)

With improvement in fuel economy and improvement in exhaust gas performance as primary purposes, the engine 1 performs combustion by compression self-ignition in a specified operation state. In regard to the combustion by the self-ignition, self-ignition timing varies significantly when the temperature inside the combustion chamber 17 before initiation of the compression fluctuates. Thus, the engine 1 performs the SPCCI combustion in which the SI combustion and the CI combustion are combined.

The SPCCI combustion is a mode in which the ignition plug 25 forcibly ignites the air-fuel mixture in the combustion chamber 17 and the SI combustion of the air-fuel mixture is performed by flame propagation and in which the CI combustion of unburned air-fuel mixture is performed by the self-ignition when the heat generated by the SI combustion increases the temperature inside the combustion chamber 17 and the pressure in the combustion chamber 17 is increased by the flame propagation.

When a heat generation amount by the SI combustion is regulated, the fluctuation of the temperature inside the combustion chamber 17 before the initiation of the compression can be offset. When the ECU 10 regulates the ignition timing, the air-fuel mixture can be subjected to the self-ignition at target timing.

Figure 3:
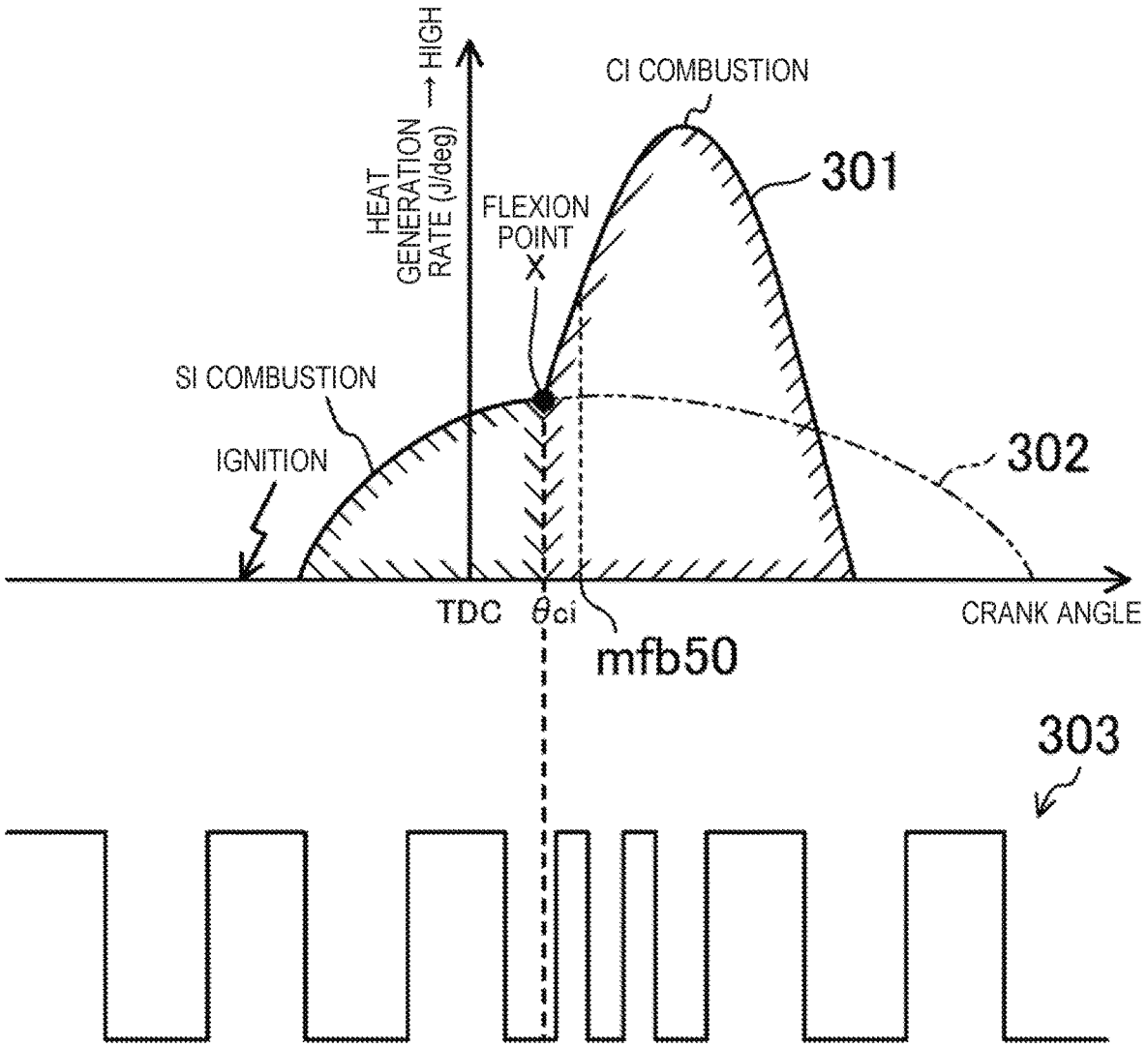
FIG. 3 include graphs, in which an upper graph is a graph exemplifying a waveform of SPCCI combustion and a lower graph is a graph exemplifying an output signal of a crank angle sensor.

In the SPCCI combustion, the heat generates at a lower rate in the SI combustion than in the CI combustion. FIG. 3 exemplifies a waveform 301 of a heat generation rate in the SPCCI combustion. The waveform 301 of the heat generation rate in the SPCCI combustion has a shallower gradient at initial rise than a gradient at initial rise of a waveform in the CI combustion. In addition, a pressure fluctuation ($dp/d\theta$) in the combustion chamber 17 is lower in the SI combustion than in the CI combustion.

When the unburned air-fuel mixture is self-ignited after the initiation of the SI combustion, at the self-ignition timing, the gradient of the waveform of the heat generation rate is possibly changed from being shallow to being steep. The waveform of the heat generation rate possibly has a flexion point X at timing $\theta ci$ at which the CI combustion is initiated.

After the initiation of the CI combustion, the SI combustion and the CI combustion are performed in parallel. The CI combustion produces more heat than the SI combustion. Thus, the heat generation rate in the CI combustion is relatively higher than that in the SI combustion. However, the CI combustion is performed after the piston 3 reaches the compression top dead center. Thus, the gradient of the waveform of the heat generation rate is avoided from becoming excessively steep. The pressure fluctuation ($dp/d\theta$) in the CI combustion is also relatively low.

The pressure fluctuation ($dp/d\theta$) can be used as an index that represents combustion noise. As described above, since the pressure fluctuation ($dp/d\theta$) is low in the SPCCI combustion, combustion noise is avoided from becoming excessively large. Combustion noise of the engine 1 is suppressed to be equal to or lower than a permissible level.

When the CI combustion is terminated, the SPCCI combustion is terminated. Compared to a case of the SI combustion only that is exemplified by a waveform 302 in FIG. 3, a combustion period of the CI combustion is short. Combustion termination timing in the SPCCI combustion is earlier than that in the SI combustion.

(Engine Operating Range)

Figure 4:
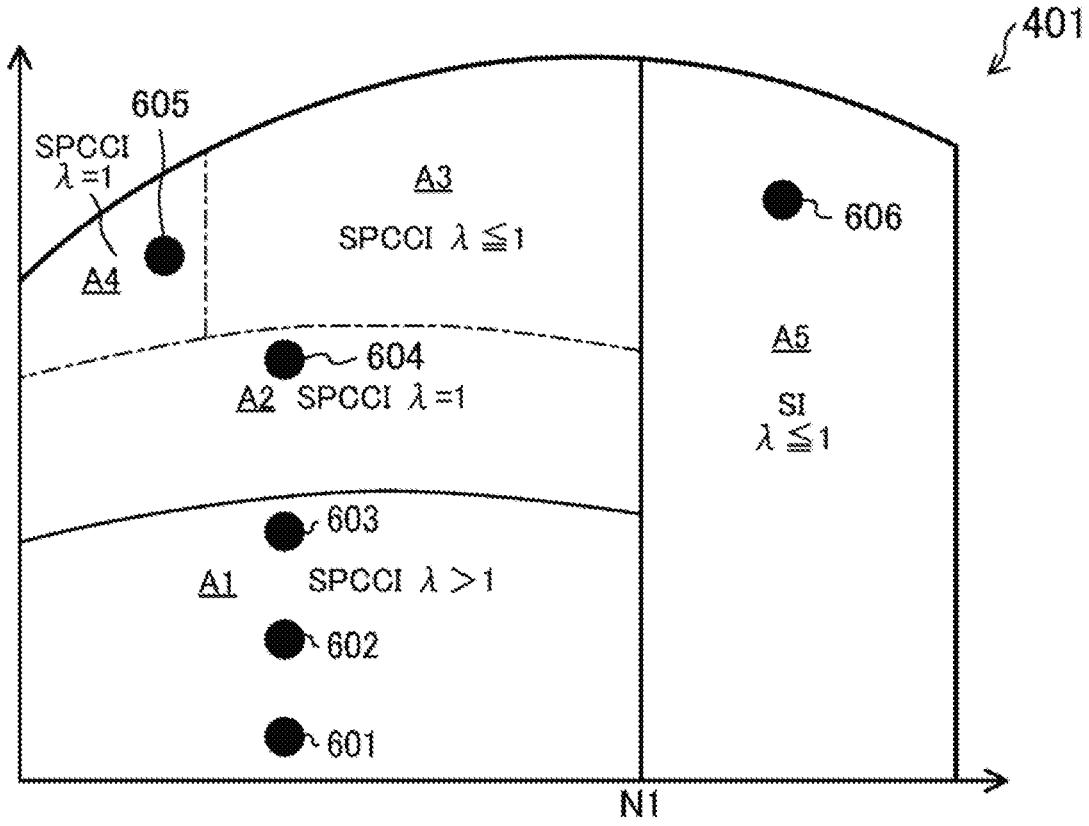
FIG. 4 is a graph exemplifying an operation map of the engine.

FIG. 4 exemplifies an operation map 401 related to control of the engine 1. The operation map 401 is stored in the memory 102 of the ECU 10. The operation map 401 is an operation map of the engine 1 in a warm period.

The operation map 401 is defined by a load and the speed of the engine 1. As boundaries are exemplified by solid lines in FIG. 4, the operation map 401 is divided into three ranges according to magnitudes of the speed and the load. More specifically, the operation map 401 is divided into a low-load range A1 in a low-speed, middle-speed range, middle-load and large-load ranges A2, A3, A4 in the low-speed, middle-speed range, and a high-speed range A5 at a speed N1 and higher.

Here, the low-speed range, the middle-speed range, and the high-speed range may respectively be set as the low-speed range, the middle-speed range, and the high-speed range in the case where the entire operating range of the engine 1 is divided into three ranges of the low-speed range, the middle-speed range, and the high-speed range in a substantially equal manner in a speed direction. Alternatively, the low-load range, the middle-load range, and the high-load range may respectively be set as the low-load range, the middle-load range, and the high-load range in the case where the entire operating range of the engine 1 is divided into three ranges of the low-load range, the middle-load range, and the high-load range in a substantially equal manner in a load direction.

Figure 5:
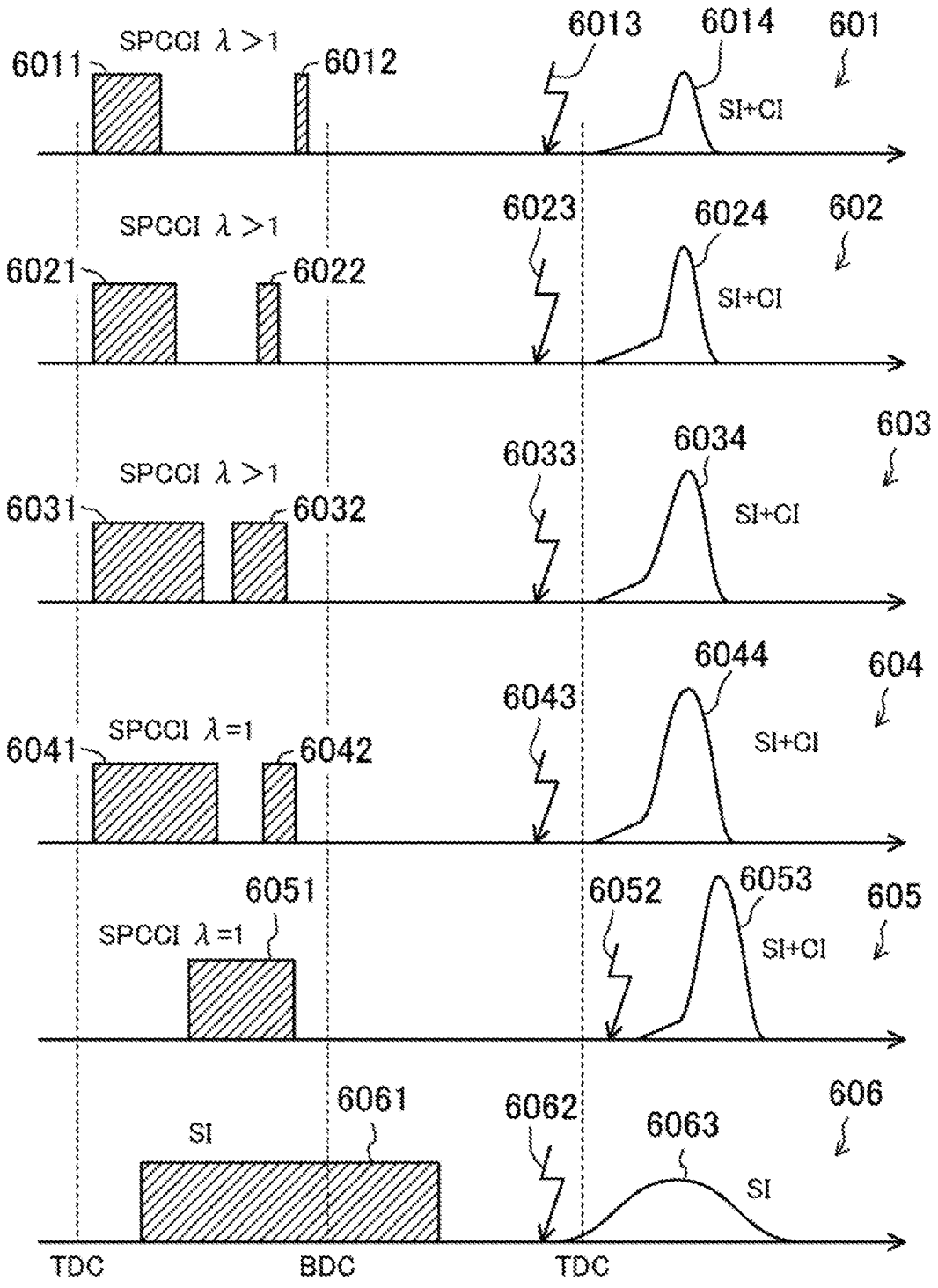
FIG. 5 include charts, each of which exemplifies fuel injection timing, ignition timing, and the combustion waveform in a respective operating range of the map in FIG. 4.

The operation map 401 indicates a state of the air-fuel mixture and a combustion mode in each of the ranges. The engine 1 performs the SPCCI combustion in the ranges A1, A2, A3, A4. The engine 1 performs the SI combustion in the range A5. A detailed description will hereinafter be made on the operation of the engine 1 in each of the ranges of the operation map 401 in FIG. 4 with reference to fuel injection timing and the ignition timing illustrated in FIG. 5. A horizontal axis in FIG. 5 represents a crank angle. The reference numerals 601, 602, 603, 604, 605, 606 in FIG. 5 respectively correspond to the operation states of the engine 1 indicated by the reference numerals 601, 602, 603, 604, 605, 606 in the operation map 401 illustrated in FIG. 4.

(Engine Operation in Range A1)

When the engine 1 is operated in the range A1, the engine 1 performs the SPCCI combustion. The reference numeral 601 in FIG. 5 represents the fuel injection timing (the reference numerals 6011, 6012), the ignition timing (the reference numeral 6013), and a combustion waveform (that is, a waveform representing a change in the heat generation rate with respect to the crank angle, the reference numeral 6014) at the time when the engine 1 is operated in the operation state 601 in the range A1 . The reference numeral 602 represents the fuel injection timing (the reference numerals 6021, 6022), the ignition timing (the reference numeral 6023), and the combustion waveform (the reference numeral 6024) at the time when the engine 1 is operated in the operation state 602 in the range A1 . The reference numeral 603 represents the fuel injection timing (the reference numerals 6031, 6032), the ignition timing (the reference numeral 6033), and the combustion waveform (the reference numeral 6034) at the time when the engine 1 is operated in the operation state 603 in the range A1. In the operation states 601, 602, 603, the speed of the engine 1 is the same while the load thereof differs. In the operation state 601, the load is the smallest (that is, the light load), which is followed by the operation state 602 (that is, the small load). Of these, the load is the largest in the operation state 603.

In order to improve fuel efficiency of the engine 1, the EGR system 55 introduces the EGR gas into the combustion chamber 17. More specifically, the intake electric S-VT 23 and the exhaust electric S-VT 24 are provided with a positive overlap period in which both of the intake valve 21 and the exhaust valve 22 are opened near exhaust top dead center. Some of the exhaust gas that is discharged from the combustion chamber 17 to the intake port 18 and the exhaust port 19 is introduced into the combustion chamber 17 again. Since the hot exhaust gas is introduced into the combustion chamber 17, the temperature inside the combustion chamber 17 is increased. This is advantageous for stabilization of the SPCCI combustion. The intake electric S-VT 23 and the exhaust electric S-VT 24 may be provided with a negative overlap period in which both of the intake valve 21 and the exhaust valve 22 are closed.

The swirl generation part generates the strong swirl flow in the combustion chamber 17. A swirl ratio is equal to or higher than 4, for example. The swirl control valve 56 is fully closed or at a specified opening degree on a closing side. As described above, since the intake port 18 is the tumble port, an oblique swirl flow having a tumble component and a swirl component is generated in the combustion chamber 17.

In the intake stroke, the injector 6 injects the fuel into the combustion chamber 17 for multiple times (the reference numerals 6011, 6012, 6021, 6022, 6031, 6032). The air-fuel mixture is stratified by the multiple times of the fuel injection and the swirl flow in the combustion chamber 17.

Concentration of the fuel in the air-fuel mixture in the central portion of the combustion chamber 17 is higher than the concentration of the fuel therein in an outer circumferential portion. More specifically, the air-fuel ratio (A/F) of the air-fuel mixture in the central portion is equal to or higher than 20 and equal to or lower than 30, and the A/F of the air-fuel mixture in the outer circumferential portion is equal to or higher than 35. Here, a value of the air-fuel ratio is a value of the air-fuel ratio at the time of the ignition, and the same applies to the following description. When the A/F of the air-fuel mixture near the ignition plug 25 is set to be equal to or higher than 20 and equal to or lower than 30, it is possible to suppress generation of raw $NO_x$ during the SI combustion. In addition, when the A/F of the air-fuel mixture in the outer circumferential portion is set to be equal to or higher than 35, the CI combustion is stabilized.

The A/F of the air-fuel mixture is leaner than the stoichiometric air-fuel ratio in the entire combustion chamber 17 (that is, an excess air ratio $\lambda>1$). In detail, the A/F of the air-fuel mixture is equal to or higher than 30 in the entire combustion chamber 17. In this way, it is possible to suppress the generation of raw $NO_x$ and thus to improve the exhaust gas performance.

When the load of the engine 1 is small (that is, at the time of the operation state 601), the injector 6 performs the first injection 6011 in a first half of the intake stroke and performs the second injection 6012 in a second half of the intake stroke. The first half of the intake stroke may be a first half when the intake stroke is equally divided into the first half and the second half, and the second half of the intake stroke may be the second half when the intake stroke is equally divided into two. An injection amount ratio between the first injection 6011 and the second injection 6012 may be 9:1, for example.

When the engine 1 is in the operation state 602 with the large load, the injector 6 initiates the second injection 6022, which is performed in the second half of the intake stroke, at an advanced timing from the timing of the second injection 6012 in the operation state 601. Since the second injection 6022 is advanced, the air-fuel mixture in the combustion chamber 17 becomes nearly homogenized. The injection amount ratio between first injection 6021 and the second injection 6022 may be set to 7:3 to 8:2, for example.

When the engine 1 is in the operation state 603 with the largest load, the injector 6 initiates the second injection 6032, which is performed in the second half of the intake stroke, at a more advanced timing from the timing of the second injection 6022 in the operation state 602. Since the second injection 6032 is advanced further, the air-fuel mixture in the combustion chamber 17 becomes further nearly homogenized. The injection amount ratio between the first injection 6031 and the second injection 6032 may be set to 6:4, for example.

After the termination of the fuel injection, the ignition plug 25 ignites the air-fuel mixture in the central portion of the combustion chamber 17 at the specified timing before compression top dead center (the reference numerals 6013, 6023, 6033). The ignition timing may be set at a termination period of the compression stroke. The termination period of the compression stroke may be set as the termination period when the compression stroke is equally divided into three periods of an initiation period, a middle period, and the termination period.

As described above, since the air-fuel mixture in the central portion has the relatively high concentration of the fuel, ignitability is improved, and the SI combustion by the flame propagation is stabilized. When the SI combustion is stabilized, the CI combustion is initiated at an appropriate timing. As a result, controllability of the CI combustion is improved. In addition, the generation of combustion noise is suppressed. Furthermore, when the SPCCI combustion is performed by setting the A/F of the air-fuel mixture to be lean, fuel efficiency of the engine 1 can be improved significantly.

(Engine Operation in Ranges A2, A3, A4)

In the case where the engine 1 is operated in any of the ranges A2, A3, A4, the engine 1 performs the SPCCI combustion. The reference numeral 604 in FIG. 5 represents the fuel injection timing (the reference numerals 6041, 6042), the ignition timing (the reference numeral 6043), and the combustion waveform (the reference numeral 6044) at the time when the engine 1 is operated in the operation state 604 in the range A2. The reference numeral 605 represents the fuel injection timing (the reference numeral 6051), the ignition timing (the reference numeral 6052), and the combustion waveform (the reference numeral 6053) at the time when the engine 1 is operated in the operation state 605 in the range A4.

The EGR system 55 introduces the EGR gas into the combustion chamber 17. More specifically, the intake electric S-VT 23 and the exhaust electric S-VT 24 are provided with the positive overlap period in which both of the intake valve 21 and the exhaust valve 22 are opened near the exhaust top dead center. Internal EGR gas is introduced into the combustion chamber 17. In addition, the EGR system 55 introduces the exhaust gas, which is cooled by the EGR cooler 53, into the combustion chamber 17 through the EGR passage 52. That is, the external EGR gas, a temperature of which is lower than that of the internal EGR gas, is introduced into the combustion chamber 17. The external EGR gas regulates the temperature inside the combustion chamber 17 to an appropriate temperature. The EGR system 55 reduces the EGR gas amount according to the increase in the load of the engine 1. With a full-open load, the EGR system 55 may reduce the EGR gas including the internal EGR gas and the external EGR gas to zero.

In the range A2 and the range A3, the swirl control valve 56 is fully closed or at a specified opening degree on a closing side. The strong swirl flow, the swirl ratio of which is equal to or higher than 4, is generated in the combustion chamber 17. Meanwhile, in the range A4, the swirl control valve 56 is opened.

The A/F of the air-fuel mixture is the stoichiometric air-fuel ratio in the entire combustion chamber 17 (A/F≈14.7). The three-way catalysts 511, 513 purify the exhaust gas that has been discharged from the combustion chamber 17. Thus, the exhaust gas performance of the engine 1 becomes favorable. The A/F of the air-fuel mixture only needs to fall within a purification window of the three-way catalysts. The excess air ratio λ of the air-fuel mixture may be set to 1.0±0.2. When the engine 1 is operated in the range A3 including the maximum load, the A/F of the air-fuel mixture may be set to the stoichiometric air-fuel ratio or be richer than the stoichiometric air-fuel ratio in the entire combustion chamber 17 (that is, the excess air ratio λ of the air-fuel mixture is λ≤1).

Since the EGR gas is introduced into the combustion chamber 17, a gas-fuel ratio (G/F) as a weight ratio between the whole gas and the fuel in the combustion chamber 17 is leaner than the stoichiometric air-fuel ratio. The G/F of the air-fuel mixture may be equal to or higher than 18. In this way, occurrence of so-called knocking can be avoided. The G/F may be set to be equal to or higher than 18 and equal to or lower than 30. The G/F may be set to be equal to or higher than 18 and equal to or lower than 50.

When the engine 1 is operated in the operation state 604, the injector 6 injects the fuel for the multiple times (the reference numerals 6041, 6042) during the intake stroke. The injector 6 may perform the first injection 6041 in the first half of the intake stroke and the second injection 6042 in the second half of the intake stroke.

When the engine 1 is operated in the operation state 605, the injector 6 injects the fuel (the reference numeral 6051) during the intake stroke.

After the fuel is injected, the ignition plug 25 ignites the air-fuel mixture at the specified timing near the compression top dead center (the reference numerals 6043, 6052). When the engine 1 is operated in the operation state 604, the ignition plug 25 may ignite the air-fuel mixture before the compression top dead center (the reference numeral 6043). When the engine 1 is operated in the operation state 605, the ignition plug 25 may ignite the air-fuel mixture after the compression top dead center (the reference numeral 6052).

The SPCCI combustion is performed by setting the A/F of the air-fuel mixture to the stoichiometric air-fuel ratio. In this way, the exhaust gas discharged from the combustion chamber 17 can be purified by using the three-way catalysts 511, 513. In addition, when the EGR gas is introduced into the combustion chamber 17 to dilute the air-fuel mixture, fuel efficiency of the engine 1 is improved.

(Engine Operation in Range A5)

When the speed of the engine 1 is high, a time required to change the crank angle by 1° is shortened. When the speed of the engine 1 is high, it is difficult to stratify the air-fuel mixture in the combustion chamber 17, which makes it difficult to perform the SPCCI combustion. Thus, in the case where the engine 1 is operated in the range A5, the engine 1 performs the SI combustion instead of the SPCCI combustion.

The reference numeral 606 in FIG. 5 represents the fuel injection timing (the reference numeral 6061), the ignition timing (the reference numeral 6062), and the combustion waveform (the reference numeral 6063) at the time when the engine 1 is operated in the operation state 606 with the large load in the range A5.

The EGR system 55 introduces the EGR gas into the combustion chamber 17. The EGR system 55 reduces the amount of the EGR gas according to the increase in the load. With the full-open load, the EGR system 55 may reduce the EGR gas to zero.

The swirl control valve 56 is fully opened. In the combustion chamber 17, the swirl flow is not generated, and only the tumble flow is generated. When the swirl control valve 56 is fully opened, charging efficiency can be improved, and pumping loss can be reduced.

The A/F of the air-fuel mixture is basically the stoichiometric air-fuel ratio in the entire combustion chamber 17 (A/F≈14.7). The excess air ratio λ of the air-fuel mixture is preferably set to 1.0±0.2. When the engine 1 is operated with the load near the full-open load, the excess air ratio λ of the air-fuel mixture may be lower than 1.

The injector 6 initiates the fuel injection during the intake stroke. The injector 6 injects the fuel all at once (the reference numeral 6061). Since the fuel injection is initiated during the intake stroke, a homogenous or a substantially homogenous air-fuel mixture is produced in the combustion chamber 17. In addition, since a long fuel vaporization time can be secured, it is possible to reduce unburned fuel loss.

After the fuel injection is terminated, the ignition plug 25 ignites the air-fuel mixture at an appropriate timing before the compression top dead center (the reference numeral 6062).

(Estimation of Temperature of Exhaust Gas)

The temperature of the exhaust gas is used for various applications in the control of the engine 1. For example, in the case where a temperature of the catalyst in the exhaust gas aftertreatment system is excessively high, reliability of the catalyst is degraded. The temperature of the exhaust gas flowing into the catalyst is monitored. Then, in the case where the temperature of the exhaust gas is excessively high, the temperature of the exhaust gas has to be reduced. In addition, for example, in order to regulate a recirculation amount of the EGR gas, the ECU 10 has to comprehend the temperature of the exhaust gas.

Attachment of a temperature sensor to the exhaust passage 50 of the engine 1 increases cost. When a plurality of sensors are used to measure the temperature of the exhaust gas flowing into the catalyst and the temperature of the exhaust gas flowing into the EGR passage 52, the cost is further increased. Accordingly, the controller in this engine 1 is configured to estimate the temperature of the exhaust gas in an uppermost stream portion of the exhaust passage 50 on the basis of a combustion state of the air-fuel mixture in the cylinder without attaching the temperature sensor to the exhaust passage 50. When estimating the temperature of the exhaust gas in the uppermost stream portion of the exhaust passage 50, the controller can further estimate the temperature of the exhaust gas flowing into the catalyst, the temperature of the exhaust gas flowing into the EGR passage 52, and the like on the basis of the temperature of the exhaust gas in the uppermost stream portion.

Figure 6:
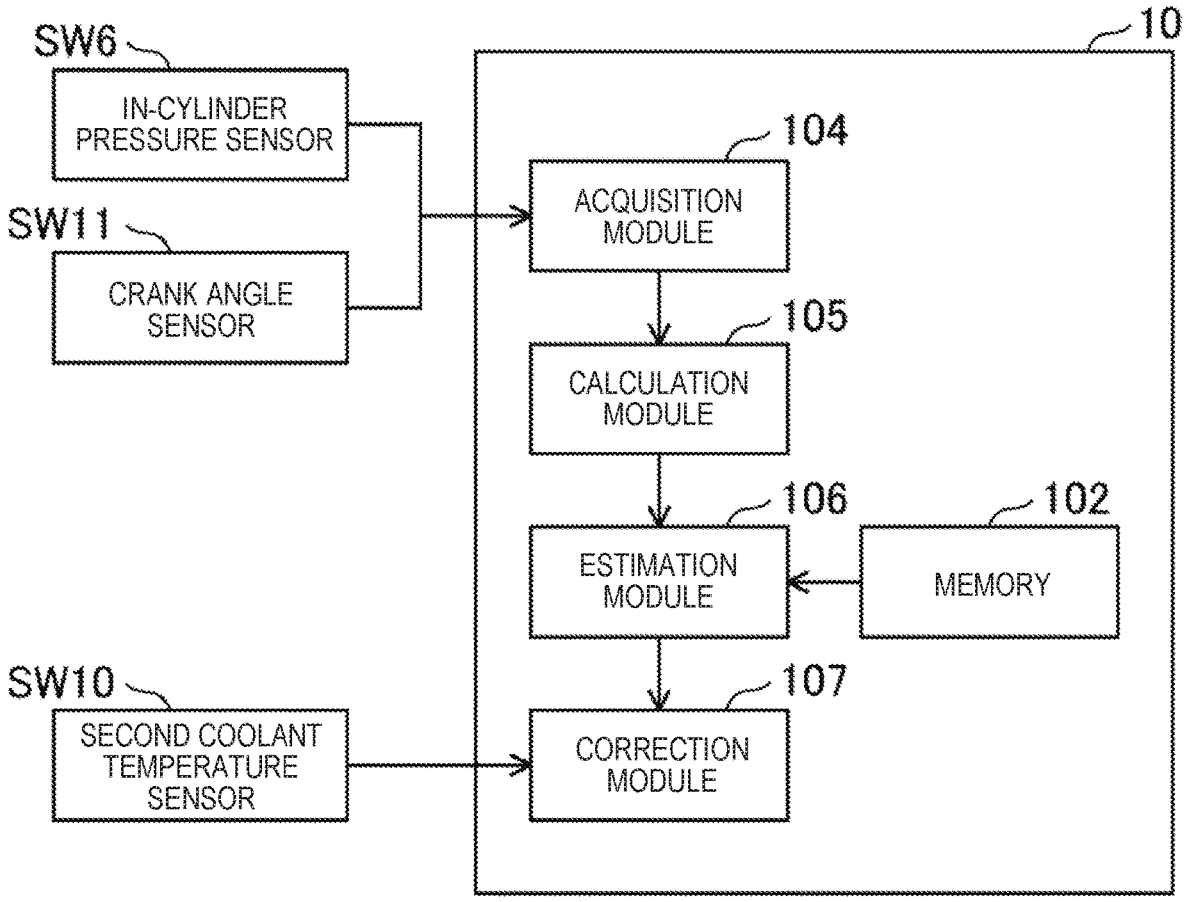
FIG. 6 is a block diagram exemplifying a functional block of an engine control unit (ECU) that estimates a temperature of exhaust gas.

FIG. 6 exemplifies software modules of the ECU 10 stored in the memory 102 which are executed by the processor 101 to perform their respective functions related to the estimation of the temperature of the exhaust gas. The ECU 10 has an acquisition module 104, a calculation module 105, an estimation module 106, and a correction module 107.

The acquisition module 104 acquires the signals of the in-cylinder pressure sensor SW6 and the crank angle sensor SW11.

The calculation module 105 calculates progress of the combustion, which is the crank angle at the time when the combustion in the cylinder is progressed to a particular extent, on the basis of the signal of the in-cylinder pressure sensor SW6 and the signal of the crank angle sensor SW11 acquired by the acquisition module 104. More specifically, the calculation module 105 may calculate the crank angle at which a mass combustion rate is 50%, that is, mfb50 (or a combustion gravity center). A method for calculating mfb50 may be a known method. More specifically, as exemplified in FIG. 3, the calculation module 105 can calculate mfb50 from an area of the waveform 301 or 302 of the heat generation rate, which is acquired from the signal of the in-cylinder pressure sensor SW6 and the signal of the crank angle sensor SW11. In the case where the mass combustion rate is correlated with the temperature of the exhaust gas, a value of the mass combustion rate, which can be used as the progress of the combustion, can be set to a value such as mfb10 or mfb90.

The calculation module 105 may calculate the combustion gravity center as the progress of the combustion on the basis of the signal of the crank angle sensor SW11, for example. For example, a waveform 303 in FIG. 3 exemplifies a temporal change in the signal of the crank angle sensor SW11. When the CI combustion is initiated during the SPCCI combustion, a crank speed is increased. Thus, a pulse interval of the crank angle sensor SW11 is reduced near the flexion point X. In addition, on the waveform 301 of the heat generation rate of the SPCCI combustion, the flexion point X and mfb50 occur at the crank angles that are close to each other. Thus, mfb50 may be calculated based on the pulse interval of the crank angle sensor SW11.

Figure 8:
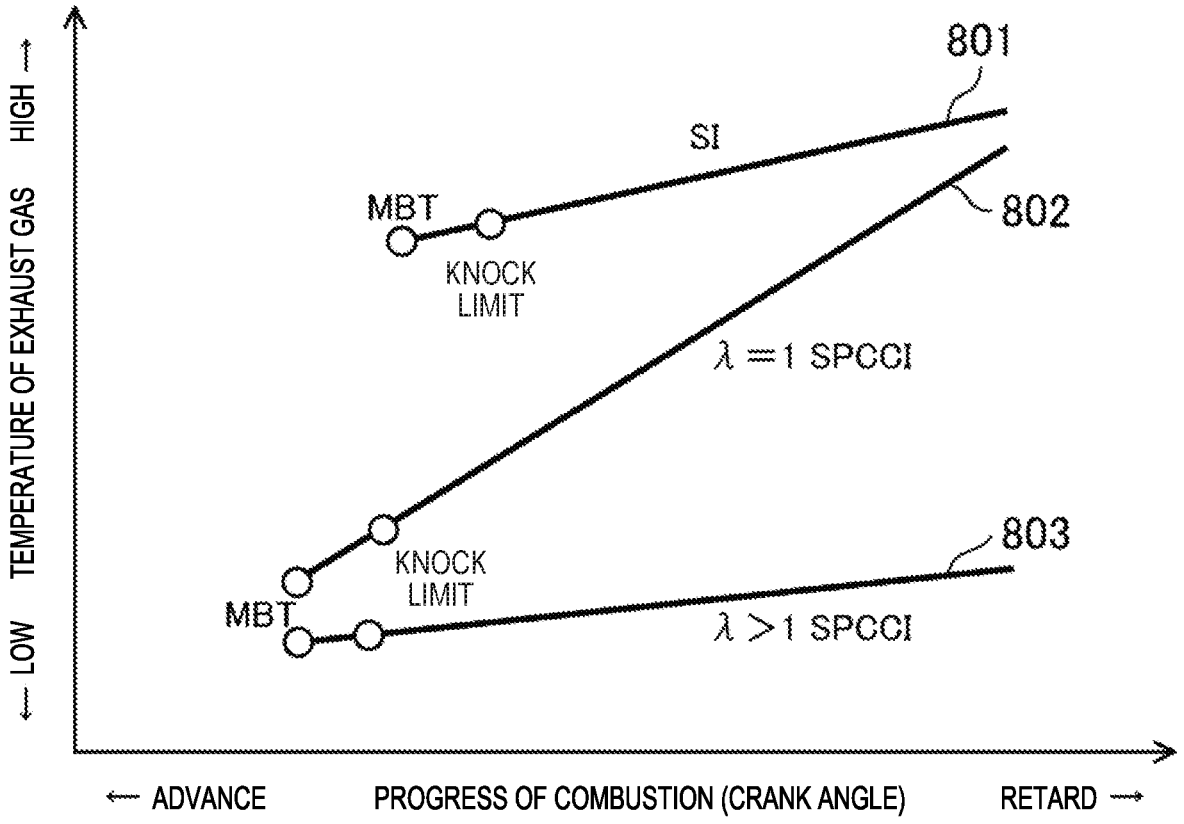
FIG. 8 is a graph exemplifying a model that represents a relationship between progress of combustion and the temperature of the exhaust gas.
Figure 9:
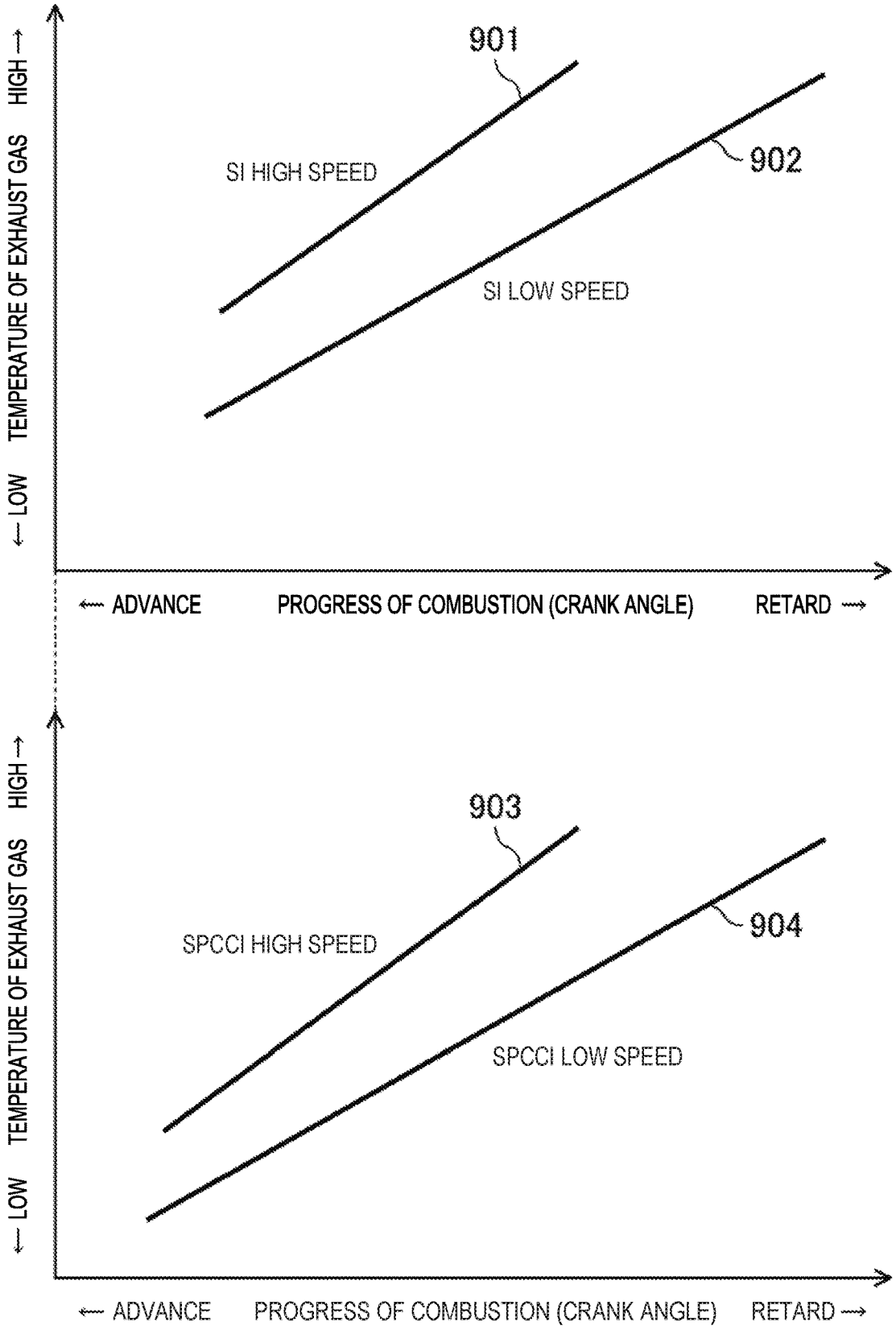
FIG. 9 include graphs, in which an upper graph is a graph exemplifying models at the time when an engine speed is high and low in SI combustion, and a lower graph is a graph exemplifying models at the time when the engine speed is high and low in the SPCCI combustion.
Figure 11:
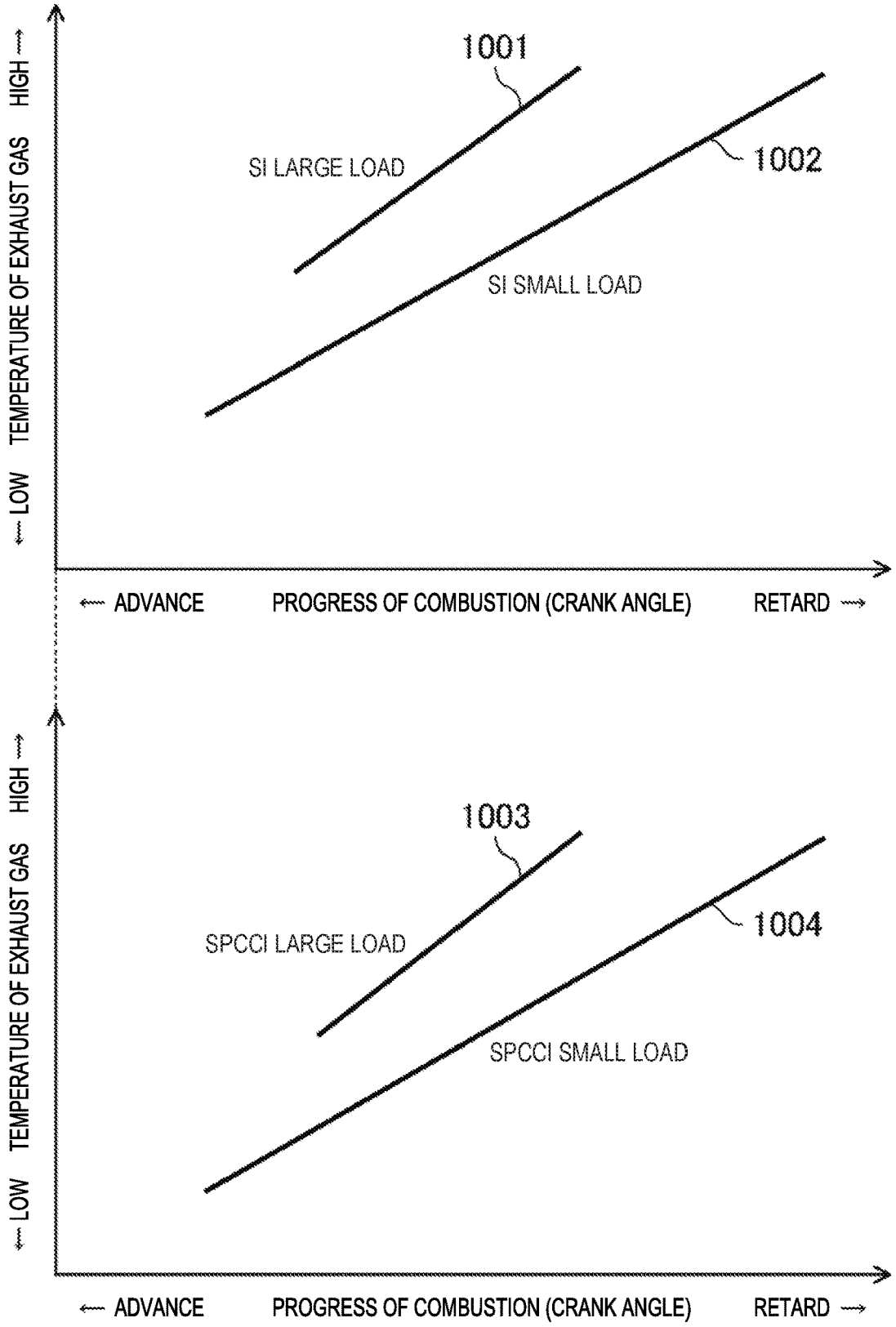
FIG. 11 include graphs, in which an upper graph is a graph exemplifying models at the time when an engine load is large and small in the SI combustion, and a lower graph is a graph exemplifying models at the time of when the engine load is large and small in the SPCCI combustion.

The estimation module 106 estimates the temperature of the exhaust gas on the basis of a relationship between the progress of the combustion and the temperature of the exhaust gas. In detail, the estimation module 106 uses a model representing the relationship between the progress of the combustion and the temperature of the exhaust gas, so as to estimate the temperature of the exhaust gas from the progress of the combustion calculated by the calculation module 105. The model is stored in the memory 102. More specifically, the model is configured as illustrated in FIG. 8, FIG. 9, and FIG. 11. A detailed description on the configuration of the model will be made later.

The correction module 107 corrects the temperature of the exhaust gas, which is estimated by the estimation module 106, according to the temperature of the engine 1. A detailed description on the correction by the correction module 107 will be made later.

Next, a description will be made on a procedure of estimating the temperature of the exhaust gas executed by the ECU 10 with reference to a flowchart in FIG. 7. An order of steps in the flowchart illustrated in FIG. 7 can be changed.

In step S1, the ECU 10 reads the signal of each of the sensors SW1 to SW17. In following step S2, the ECU 10 injects and ignites the fuel according to the operation state of the engine 1 (see FIG. 4 and FIG. 5).

Next, in step S3, the acquisition module 104 of the ECU 10 acquires the signals of the in-cylinder pressure sensor SW6 and the crank angle sensor SW11 during the combustion in the cylinder. In following step S4, the calculation module 105 calculates the progress of the combustion.

In step S5, the estimation module 106 of the ECU 10 determines whether a combustion mode of the engine 1 is the SI combustion. If the combustion mode is the SI combustion, and thus, the determination in step S5 is YES, the processing proceeds to step S6. If the combustion mode is the SPCCI combustion and thus the determination in step S5 is NO, the processing proceeds to step S8.

In step S8, the estimation module 106 determines whether the air-fuel ratio of the air-fuel mixture is the stoichiometric air-fuel ratio. If the air-fuel ratio is the stoichiometric air-fuel ratio (that is, $\lambda=1$), and thus, the determination in step S8 is YES, the processing proceeds to step S9. If the air-fuel ratio is lean (that is, $\lambda>1$), and thus, the determination in step S8 is NO, the processing proceeds to step S11.

In step S6, the estimation module 106 estimates the temperature of the exhaust gas from the model stored in the memory 102 and the calculated degree of the progress of the combustion. FIG. 8 exemplifies a model that represents the relationship between the progress of the combustion and the temperature of the exhaust gas. FIG. 8 exemplifies a model 801 in the SI combustion, a model 802 in the SPCCI combustion at the time when the air-fuel ratio is the stoichiometric air-fuel ratio, and a model 803 in the SPCCI combustion at the time when the air-fuel ratio is lean.

As it is understood from FIG. 8, each of the models is represented by a linear function. This is because the present inventors have found that a linear correlation existed between the progress of the combustion and the temperature of the exhaust gas in the case where the progress of the combustion was delayed from the progress of the combustion at MBT.

In the SI combustion and the SPCCI combustion, the air-fuel mixture is ignited. When the ignition timing is delayed, the temperature of the exhaust gas is increased. Thus, a correlation exists between the ignition timing and the temperature of the exhaust gas. However, according to the research by the present inventors, in the so-called spark-ignition engine in which the SI combustion and/or the SPCCI combustion is performed, the relationship between the ignition timing and the temperature of the exhaust gas was not linear but non-linear.

When the ignition timing is delayed, the combustion is initiated in the power stroke. The power stroke is a stroke in which a volume inside the cylinder is increased. The increase in the volume has a non-linear relationship with advancement in the crank angle. The combustion in the power stroke is affected by the non-linear increase in the volume. The degree of the progress of the combustion has a non-linear relationship (for example, a quadratic function) with a delay in the ignition timing.

The degree of the progress of the combustion is a parameter that represents the combustion state. Thus, a linear correlation is established between the progress of the combustion and the illustrated work of the engine 1. In addition, the temperature of the exhaust gas is determined from the quantity of heat, which is acquired by subtracting the quantity of heat used for the illustrated work of the engine from the quantity of heat generated by the combustion in the cylinder. Accordingly, a linear correlation is also established between the illustrated work of the engine and the temperature of the exhaust gas. Since the ignition timing and the progress of the combustion have the non-linear relationship, the correlation between the ignition timing and the temperature of the exhaust gas is non-linear. Meanwhile, the correlation between the progress of the combustion and the temperature of the exhaust gas is linear.

Thus, each of the models 801, 802, 803 is configured such that, in the case where the progress of the combustion is delayed from the progress of the combustion at maximum brake torque (MBT), the temperature of the exhaust gas is estimated to be higher in a linear manner as the progress of the combustion is delayed. In the case where the progress of the combustion is delayed from the progress of the combustion at the MBT, the estimation module 106 estimates the temperature of the exhaust gas to be higher in the linear manner as the progress of the combustion is delayed according to the models 801, 802, 803.

Meanwhile, in the case where the ignition timing is excessively advanced, abnormal combustion possibly occurs. As an advancement limit of the ignition timing at which the abnormal combustion does not occur, a knock limit is set. The knock limit is set on a delayed side from the MBT. The ignition timing is set to be delayed from the knock limit.

As illustrated in FIG. 8, even in the case where the progress of the combustion is delayed from the progress of the combustion at the knock limit, the linear correlation is established between the progress of the combustion and the temperature of the exhaust gas. Each of the models 801, 802, 803 is configured such that, in the case where the progress of the combustion is delayed from the progress of the combustion at the knock limit, the temperature of the exhaust gas is estimated to be higher in the linear manner as the progress of the combustion is delayed. In the case where the progress of the combustion is delayed from the progress of the combustion at the knock limit, the estimation module 106 estimates the temperature of the exhaust gas to be higher in the linear manner as the progress of the combustion is delayed according to the models 801, 802, 803.

Each of the models 801, 802, 803 is linear. Thus, even in the case where the progress of the combustion is significantly delayed from the progress of the combustion at the MBT, the estimation module 106 can accurately estimate the temperature of the exhaust gas.

The model 801 in the SI combustion differs from the models 802, 803 in the SPCCI combustion. The model 801 represents a first relationship between the progress of the combustion and the temperature of the exhaust gas in the SI combustion. Each of the models 802, 803 represents a second relationship between the progress of the combustion and the temperature of the exhaust gas in the SPCCI combustion. In response to switching of the combustion mode, the estimation module 106 switches the model among the models 801, 802, 803 and estimates the temperature of the exhaust gas. In this way, in each of the SI combustion and the SPCCI combustion, the estimation module 106 can accurately estimate the temperature of the exhaust gas.

In detail, the model 801 in the SI combustion is configured such that the temperature of the exhaust gas at the same degree of the progress of the combustion is estimated to be higher than that in each of the models 802, 803 in the SPCCI combustion. Thus, in the case where the progress of the combustion is the same, the estimation module 106 estimates the temperature of the exhaust gas to be higher in the SI combustion than in the SPCCI combustion.

In the SPCCI combustion, some of the unburned air-fuel mixture is burned by the self-ignition. Thus, thermal efficiency in the SPCCI combustion is higher than that in the SI combustion. As a result, the temperature of the exhaust gas is lower in the SPCCI combustion than in the SI combustion. On the contrary, the temperature of the exhaust gas is higher in the SI combustion than in the SPCCI combustion. The model 801 in the SI combustion is configured such that the temperature of the exhaust gas at the same degree of the progress of the combustion is estimated to be higher than that in each of the models 802, 803 in the SPCCI combustion. Thus, in each of the SI combustion and the SPCCI combustion, the estimation module 106 can accurately estimate the temperature of the exhaust gas.

The model 802 in the SPCCI combustion is configured such that, when the air-fuel ratio of the air-fuel mixture is the stoichiometric air-fuel ratio, a temperature increasing rate of the exhaust gas with respect to a change in the progress of the combustion is higher than the temperature increasing rate of the model 801 in the SI combustion. A gradient of each of the straight lines in FIG. 8 corresponds to a "temperature increasing rate of the exhaust gas with respect to the change in the progress of the combustion".

As described above, thermal efficiency is high in the SPCCI combustion. Meanwhile, in the SPCCI combustion, the air-fuel mixture is partially subjected to the CI combustion. The CI combustion in the power stroke is significantly affected by a change in the volume. More specifically, when the progress of the combustion is delayed, thermal efficiency in the SPCCI combustion is significantly degraded. In the SPCCI combustion, the temperature of the exhaust gas is significantly changed with respect to the change in the progress of the combustion. Meanwhile, the SI combustion by the flame propagation is less likely to be affected by the change in the volume. Even when the progress of the combustion is delayed in the SI combustion, thermal efficiency in the SI combustion is not significantly degraded. In the SI combustion, the change in the temperature of the exhaust gas with respect to the change in the progress of the combustion is small.

Thus, in the model 802 in the SPCCI combustion, the temperature increasing rate of the exhaust gas with respect to the change in the progress of the combustion is set to be higher than that in the model 801 in the SI combustion. That is, the gradient of the model 802 is steeper than that of the model 801. In this way, in each of the SI combustion and the SPCCI combustion, the estimation module 106 can accurately estimate the temperature of the exhaust gas.

Each of the models 801, 802 at the time when the air-fuel ratio of the air-fuel mixture is stoichiometric air-fuel ratio differs from the model 803 at the time when the air-fuel ratio of the air-fuel mixture is lean. Furthermore, in the SPCCI combustion, each of the models 801, 802 at the time when the air-fuel ratio of the air-fuel mixture is the stoichiometric air-fuel ratio differs from the model 803 at the time when the air-fuel ratio of the air-fuel mixture is lean. The estimation module 106 switches between the models 802, 803 in response to switching of the air-fuel ratio of the air-fuel mixture in the SPCCI combustion, so as to estimate the temperature of the exhaust gas. Thus, the estimation module 106 can accurately estimate the temperature of the exhaust gas.

In detail, the model 803 at the time when the air-fuel ratio of the air-fuel mixture is lean is configured such that the temperature of the exhaust gas at the same degree of the progress of the combustion is estimated to be lower than that in the model 802 at the time when the air-fuel ratio is the stoichiometric air-fuel ratio. Thus, in the case where the progress of the combustion is the same, the estimation module 106 estimates the temperature of the exhaust gas to be lower at the time when the air-fuel ratio is lean than at the time when the air-fuel ratio is the stoichiometric air-fuel ratio.

In the case where the air-fuel ratio of the air-fuel mixture is lean, the thermal efficiency of the engine 1 is relatively high, which reduces the temperature of the exhaust gas. The model 803 at the time when the air-fuel ratio is lean is configured such that the temperature of the exhaust gas at the same degree of the progress of the combustion is estimated to be lower than that in each of the models 801, 802 at the time when the air-fuel ratio is the stoichiometric air-fuel ratio. Thus, when the air-fuel ratio is the stoichiometric air-fuel ratio, and when the air-fuel ratio is lean, the estimation module 106 can accurately estimate the temperature of the exhaust gas.

The model 803 at the time when the air-fuel ratio of the air-fuel mixture is lean is configured such that the temperature increasing rate of the exhaust gas with respect to the change in the progress of the combustion is lower than the temperature increasing rate of the model 802 at the time when the air-fuel ratio is the stoichiometric air-fuel ratio. That is, the gradient of the model 803 is shallower than that of the model 802.

As described above, the thermal efficiency is high in the SPCCI combustion. When the air-fuel ratio of the air-fuel mixture is lean, thermal efficiency of the engine 1 is further increased. In the SPCCI combustion, a case where the air-fuel ratio of the air-fuel mixture is the stoichiometric air-fuel ratio and a case where the air-fuel ratio thereof is lean are compared. In such a case, an amount of the fuel supplied to the cylinder is small when the air-fuel ratio is lean, and the heat generation amount in the cylinder is also small when the air-fuel ratio is lean. The heat generation amount in the cylinder is small. Thus, the change in the temperature of the exhaust gas with respect to the delay in the progress of the combustion is small when the air-fuel ratio of the air-fuel mixture is lean. Thus, in the model 803 at the time when air-fuel ratio of the air-fuel mixture is lean, the temperature increasing rate of the exhaust gas with respect to the change in the progress of the combustion is lower than the temperature increasing rate of the model 802 at the time when the air-fuel ratio is the stoichiometric air-fuel ratio.

The model is changed according to the speed of the engine 1. FIG. 9 exemplifies models 901, 903 when the speed of the engine 1 is high and models 902, 904 when the speed of the engine 1 is low. An upper graph in FIG. 9 is a model in the SI combustion, and a lower graph therein is a model in the SPCCI combustion.

As illustrated in the upper graph in FIG. 9, the model 901 of the case where the speed of the engine 1 is high is configured such that the temperature of the exhaust gas with respect to the same degree of the progress of the combustion is estimated to be higher than that in the model 902 of the case where the speed of the engine 1 is low. In the case where the progress of the combustion is the same, the estimation module 106 estimates the temperature of exhaust gas to be higher when the speed of the engine 1 is high than when the speed thereof is low.

The temperature of the exhaust gas is higher when the speed of the engine 1 is high than when the speed thereof is low. This is because the number of combustions per unit time is increased with the increase in the speed of the engine 1, thus a cylinder wall temperature is increased, and the cooling loss is suppressed due to a short combustion time in the cylinder.

Each of the models 901, 902 is configured such that the temperature of the exhaust gas with respect to the same degree of the progress of the combustion is estimated to be higher when the speed of the engine 1 is high than when the speed thereof is low. In this way, even in the case where the speed of the engine 1 is changed, the estimation module 106 can accurately estimate the temperature of the exhaust gas.

The same applies to the SPCCI combustion as illustrated in the lower graph in FIG. 9. That is, the model 903 of the case where the speed of the engine 1 is high is configured such that the temperature of the exhaust gas with respect to the same degree of the progress of the combustion is estimated to higher than that in the model 904 of the case where the speed thereof is low. In this way, even in the case where the speed of the engine 1 is changed during the SPCCI combustion, the estimation module 106 can accurately estimate the temperature of the exhaust gas.

In addition, as illustrated in the upper graph in FIG. 9, the model 901 of the case where the speed of the engine 1 is high is configured such that the temperature increasing rate of the exhaust gas with respect to the change in the progress of the combustion is higher than that in the model 902 of the case where the speed of the engine 1 is low. That is, the gradient of the model 901 is steeper than that of the model 902.

As described above, in the case where the speed of the engine 1 is high, the cylinder wall temperature is high, and a difference between the in-cylinder temperature and the cylinder wall temperature is relatively small. In the case where the speed of the engine 1 is high and where the in-cylinder temperature is changed in conjunction with the change in the progress of the combustion, a ratio of a variation in the in-cylinder temperature to the difference between the in-cylinder temperature and the cylinder wall temperature during the combustion is increased. That is, in the case where the speed of the engine 1 is high and the progress of the combustion is changed, the cooling loss is significantly changed. Thus, the temperature of the exhaust gas is also significantly changed. On the contrary, in the case where the speed of the engine 1 is low, the cylinder wall temperature is low, and the difference between the in-cylinder temperature and the cylinder wall temperature during the combustion is relatively large. Even in the case where the speed of the engine 1 is low and where the in-cylinder temperature is changed due to the change in the progress of the combustion, the change in the temperature of the exhaust gas is small due to the small ratio of the variation in the in-cylinder temperature to the difference between the in-cylinder temperature and the cylinder wall temperature.

Each of the models 901, 902 is configured such that the temperature increasing rate of the exhaust gas with respect to the change in the progress of the combustion is higher when the speed of the engine 1 is high than when the speed thereof is low. In this way, the estimation module 106 can accurately estimate the temperature of the exhaust gas even when the speed of the engine 1 is changed.

Furthermore, as illustrated in the lower graph in FIG. 9, also in the SPCCI combustion, the model 903 of the case where the speed of the engine 1 is high is configured such that the temperature increasing rate of the exhaust gas with respect to the change in the progress of the combustion is higher than that in the model 904 of the case where the speed of the engine 1 is low. That is, the gradient of the model 903 is steeper than that of the model 904.

Figure 10:
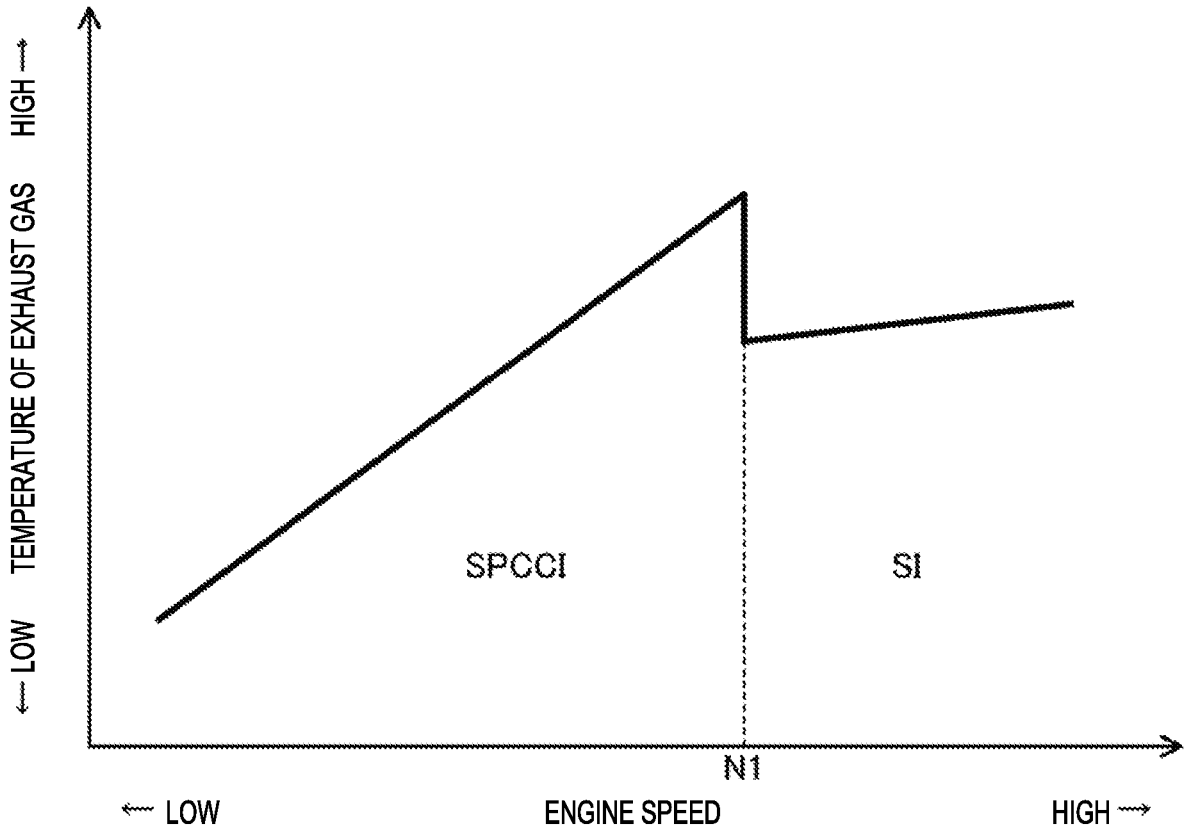
FIG. 10 is a graph exemplifying a relationship between the engine speed and the temperature of the exhaust gas.

Here, FIG. 10 exemplifies a relationship between the speed of the engine 1 and the estimated temperature of the exhaust gas with the certain engine load. As illustrated in FIG. 4, the speed N1 of the engine 1 in the operation map 401 is the speed at which the combustion mode is switched between the SPCCI combustion and the SI combustion. Accordingly, the engine 1 performs the SPCCI combustion on a left side of N1 in FIG. 10, and the engine 1 performs the SI combustion on a right side of N1.

In the case where the speed of the engine 1 is lower than N1, the progress of the combustion in the SPCCI combustion is delayed with the increase in the speed. As a result, the temperature of the exhaust gas is gradually increased.

When the speed of the engine 1 is N1, the combustion mode is switched between the SPCCI combustion and the SI combustion. The progress of the combustion in the SI combustion is advanced in comparison with the progress of the combustion in the SPCCI combustion. Thus, the temperature of the exhaust gas is reduced when the SPCCI combustion is switched to the SI combustion. Meanwhile, the temperature of the exhaust gas is increased when the SI combustion is switched to the SPCCI combustion.

In the case where the speed of the engine 1 is equal to or higher than N1, the progress of the combustion in the SI combustion is also delayed as the speed is increased. Thus, the temperature of the exhaust gas is gradually increased. However, the temperature increasing rate of the exhaust gas with respect to the increase in the speed of the engine 1 is lower in the SI combustion than in the SPCCI combustion. That is, the gradient of the line in FIG. 10 is gentle. This is because, in the SI combustion, the amount of the delay in the progress of the combustion with respect to the increase in the speed of the engine 1 is small.

The SPCCI combustion, which significantly depends on the temperature and a pressure state inside the cylinder, is likely to be affected by the change in the in-cylinder volume during the power stroke. In the SPCCI combustion, the amount of the delay in the progress of the combustion with respect to the speed of the engine 1 is large. Thus, in the SPCCI combustion, the temperature increasing rate of the exhaust gas with respect to the increase in the speed is high. That is, the gradient of the line in FIG. 10 is steep.

FIG. 11 exemplifies models 1001, 1003 when the load of the engine 1 is large and models 1002, 1004 when the load of the engine 1 is small. The model is changed according to the load of the engine 1. An upper graph in FIG. 11 includes the models in the SI combustion, and a lower graph therein includes the models in the SPCCI combustion.

As illustrated in the upper graph in FIG. 11, the model 1001 of the case where the load of the engine 1 is large is configured such that the temperature of the exhaust gas with respect to the same degree of the progress of the combustion is estimated to be higher than in the model 1002 of the case where the load is small. In the case where the progress of the combustion is the same, the estimation 4 module 106 estimates the temperature of exhaust gas to be higher when the load of the engine 1 is large than when the load thereof is small.

When the load of the engine 1 is large, the amount of the fuel supplied to the cylinder is increased, and thus, the heat generation amount in the cylinder is increased. The models 1001, 1002 are configured such that the temperature of the exhaust gas with respect to the same degree of the progress of the combustion is estimated to be higher when the load of the engine 1 is large than when the load thereof is small. Thus, the estimation module 106 can accurately estimate the temperature of the exhaust gas even when the load of the engine 1 is changed.

The same applies to the SPCCI combustion as illustrated in the lower graph in FIG. 11. More specifically, the model 1003 of the case where the load of the engine 1 is large is configured such that the temperature of the exhaust gas with respect to the same degree of the progress of the combustion is estimated to be higher than in the model 1004 of the case where the load is small. In this way, in the SPCCI combustion, even when the load of the engine 1 is changed, the estimation module 106 can accurately estimate the temperature of the exhaust gas.

In addition, as illustrated in the upper graph in FIG. 11, the model 1001 of the case where the load of the engine 1 is large is configured such that the temperature increasing rate of the exhaust gas with respect to the change in the progress of the combustion is higher than that in the model 1002 of the case where the load of the engine 1 is small. That is, the gradient of the model 1001 is steeper than that of the model 1002.

When the load of the engine 1 is large, the fuel supply amount is large. In the case where the load of the engine 1 is large and the progress of the combustion is changed, the variation in the illustrated work becomes significant. As a result, the temperature of the exhaust gas is also significantly changed. On the contrary, in the case where the load of the engine 1 is small, the fuel supply amount is small. Thus, even in the case where the progress of the combustion is changed, the variation in the illustrated work is insignificant. As a result, the change in the temperature of the exhaust gas is small.

The models 1001, 1002 are configured such that the temperature increasing rate of the exhaust gas with respect to the change in the progress of the combustion is higher when the load of the engine 1 is large than when the load of the engine 1 is small. In this way, even in the case where the load of the engine 1 is changed, the estimation module 106 can accurately estimate the temperature of the exhaust gas.

As illustrated in the lower graph in FIG. 11, also in the SPCCI combustion, the model 1003 of the case where the load of the engine 1 is large is configured such that the temperature increasing rate of the exhaust gas with respect to the change in the progress of the combustion is higher than that of the model 1004 of the case where the load of the engine 1 is small. That is, the gradient of the model 1003 is steeper than that of the model 1004.

Figure 7:
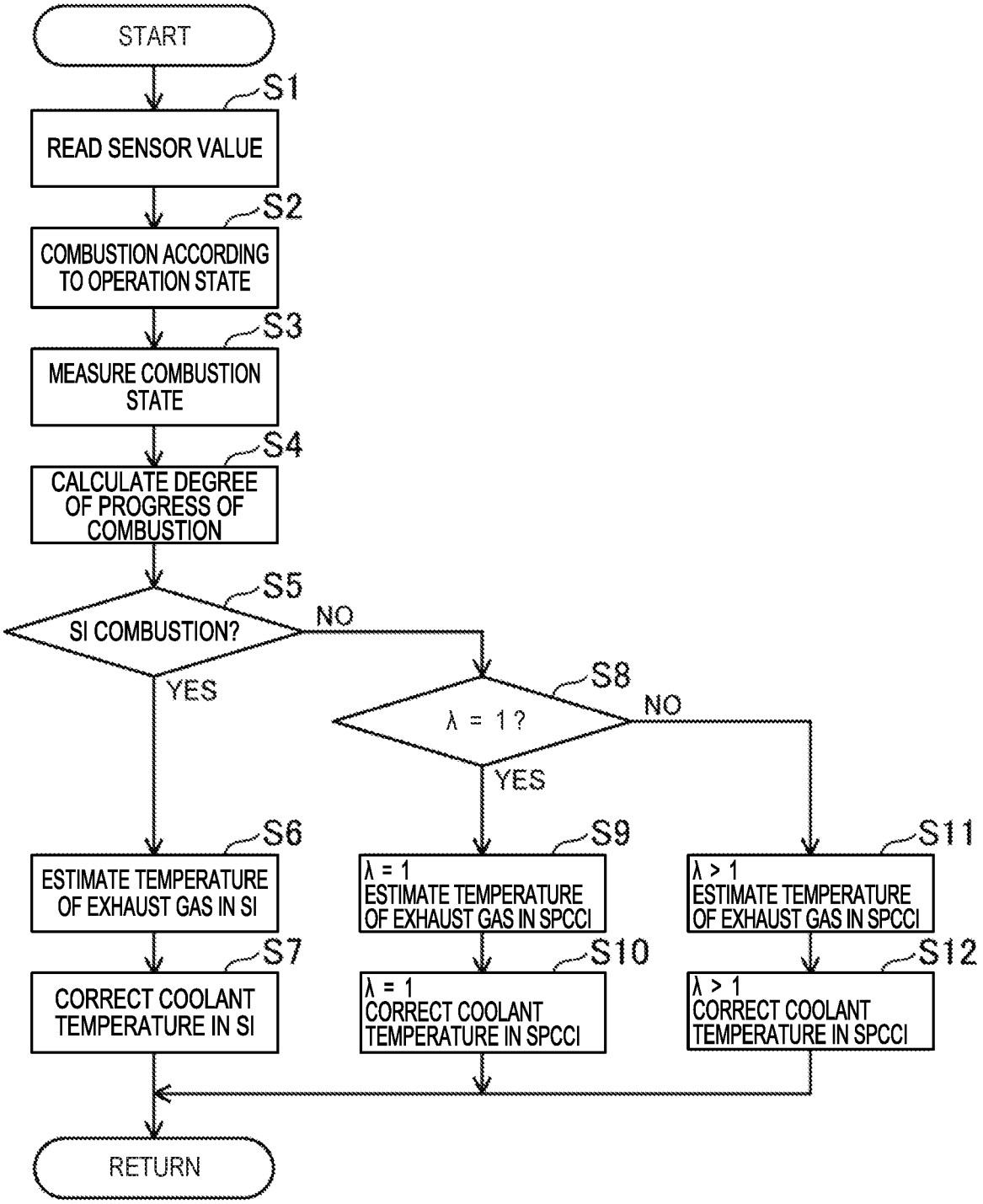
FIG. 7 is a flowchart exemplifying a procedure of estimating the temperature of the exhaust gas that is executed by the ECU.

Referring back to the flowchart in FIG. 7, in step S6, the estimation module 106 estimates the temperature of the exhaust gas by using the model corresponding to the SI combustion (for example, the model 801). In step S9, the estimation module 106 estimates the temperature of the exhaust gas by using the model corresponding to the case where the air-fuel ratio of the air-fuel mixture is the stoichiometric air-fuel ratio in the SPCCI combustion (for example, the model 802). In step S11, the estimation module 106 estimates the temperature of the exhaust gas by using the model corresponding to the case where the air-fuel ratio of the air-fuel mixture is lean in the SPCCI combustion (for example, the model 803).

In step S7 following step S6, the correction module 107 of the ECU 10 corrects the temperature of the exhaust gas, which is estimated in step S6, according to the temperature of the engine 1. In step S10 following step S9, the correction module 107 corrects the temperature of the exhaust gas, which is estimated in step S9, according to the temperature of the engine 1. In step S12 following step S11, the correction module 107 corrects the temperature of the exhaust gas, which is estimated in step S11, according to the temperature of the engine 1.

The temperature of the engine 1 is represented by the temperature of the coolant for the engine 1. The correction module 107 acquires the temperature of the coolant for the engine 1 from the signal of the second coolant temperature sensor SW10.

Figure 12:
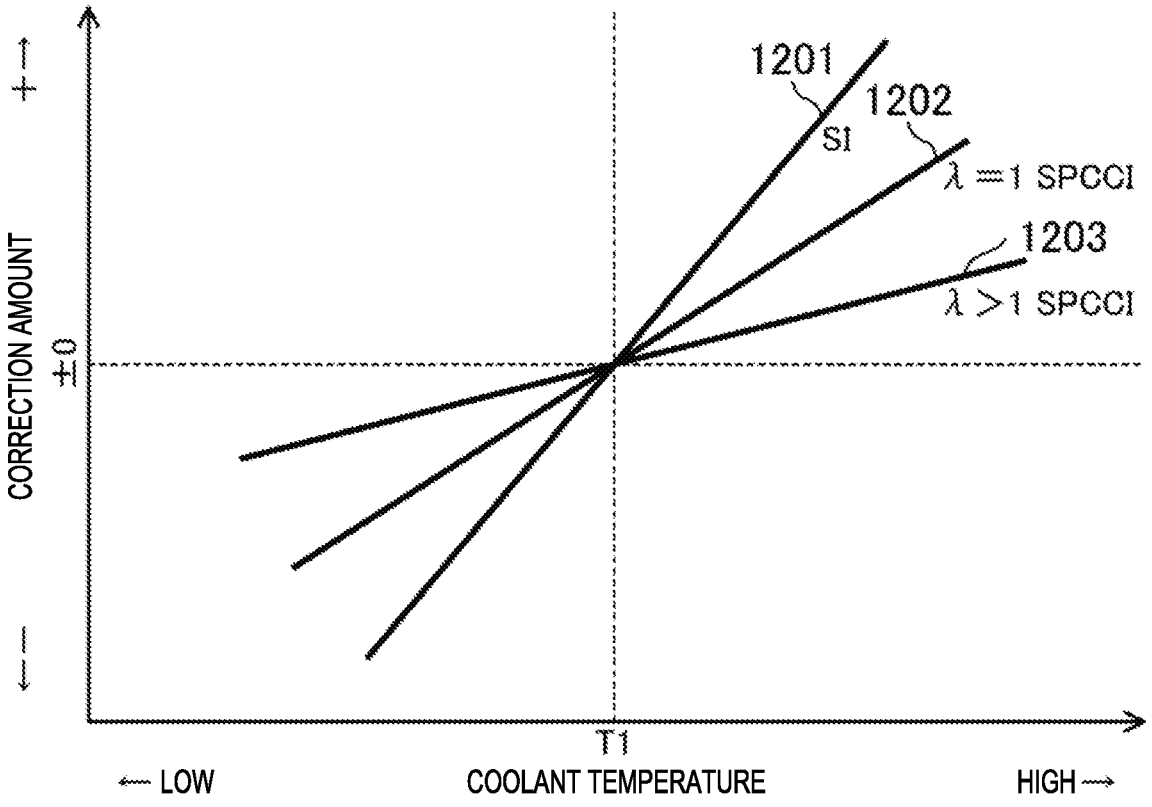
FIG. 12 is a graph exemplifying a relationship between a temperature of a coolant and a correction amount of the temperature of the exhaust gas.

FIG. 12 exemplifies a relationship between the temperature of the coolant and a correction amount of the temperature of the exhaust gas. T1 represents a reference temperature of the coolant. The above-described models 801, 802, 803, 901, 902, 903, 904, 1001, 1002, 1003, 1004 each represent the relationship between the progress of the combustion and the temperature of the exhaust gas in the case where the coolant is at the reference temperature T1.

When the temperature of the coolant is T1, the correction amount is zero. The correction module 107 does not actually correct the temperature of the exhaust gas estimated in steps S6, S9, S11. When the temperature of the coolant is higher than T1, the correction amount becomes larger than zero. As the temperature of the coolant is increased, the positive correction amount is increased. The correction module 107 makes correction to increase the temperature of the exhaust gas estimated in steps S6, S9, S11. As the temperature of the engine 1 is increased, the cooling loss is reduced. Thus, the temperature of the exhaust gas is increased. When the correction module 107 makes the correction to increase the temperature of the exhaust gas, the ECU 10 can further accurately estimate the temperature of the exhaust gas.

When the temperature of the coolant is lower than T1, the correction amount becomes smaller than zero. As the temperature of the coolant is reduced, the negative correction amount is increased. The correction module 107 makes correction to reduce the temperature of the exhaust gas estimated in steps S6, S9, S11. As the temperature of the engine 1 is reduced, the cooling loss is increased. Thus, the temperature of the exhaust gas is reduced. When the correction module 107 makes the correction to reduce the temperature of the exhaust gas, the ECU 10 can further accurately estimate the temperature of the exhaust gas.

The correction amount is changed according to the air-fuel ratio of the air-fuel mixture. More specifically, a straight line 1202 in FIG. 12 represents the correction amount of the case where the air-fuel ratio of the air-fuel mixture is stoichiometric air-fuel ratio in the SPCCI combustion. A straight line 1203 represents the correction amount of the case where the air-fuel ratio of the air-fuel mixture is lean in the SPCCI combustion. As understood from FIG. 12, in the case where the air-fuel ratio of the air-fuel mixture is the stoichiometric air-fuel ratio, the correction amount of the temperature of the exhaust gas is increased to be larger than in the case where the air-fuel ratio is lean.

In the case where the air-fuel ratio of the air-fuel mixture is lean, thermal efficiency of the engine 1 is relatively high, which reduces the amount of the fuel supplied to the cylinder. As a result, the temperature inside the cylinder during the combustion is lower when the air-fuel ratio of the air-fuel mixture is lean than when the air-fuel ratio is the stoichiometric air-fuel ratio. In addition, the cooling loss is also reduced to be smaller when the air-fuel ratio is lean than when the air-fuel ratio is the stoichiometric air-fuel ratio. On the contrary, in the case where the air-fuel ratio of the air-fuel mixture is the stoichiometric air-fuel ratio, the cooling loss is increased.

The correction module 107 makes the correction in consideration of the influence of the cooling loss. Thus, in the case where the air-fuel ratio of the air-fuel mixture is the stoichiometric air-fuel ratio, the correction amount of the temperature of the exhaust gas is increased to be larger than in the case where the air-fuel ratio is lean. In this way, the correction module 107 can appropriately correct the temperature of the exhaust gas in consideration of the relationship between the air-fuel ratio of the air-fuel mixture and the cooling loss.

The correction amount is changed according to the combustion mode. More specifically, a straight line 1201 in FIG. 12 represents the correction amount in the SI combustion. As understood from FIG. 12, the correction amount of the temperature of the exhaust gas is increased to be larger in the SI combustion than in the SPCCI combustion.

In the SPCCI combustion, the heat generation rate in the CI combustion is high. Thus, a peak temperature inside the cylinder is higher than the peak temperature in the SI combustion. In the SPCCI combustion, a difference between the peak temperature and the temperature of the coolant is significant. Thus, a ratio of a temperature change amount of the coolant to the difference between the peak temperature and the temperature of the coolant in the case where the temperature of the coolant is changed is small. Thus, in the SPCCI combustion, even when the temperature of the coolant is changed, the amount of the cooling loss is not significantly changed. In the SPCCI combustion, even when the temperature of the coolant is changed, the temperature of the exhaust gas is not significantly changed.

Meanwhile, in the SI combustion, the difference between the peak temperature and the temperature of the coolant is small. Thus, the ratio of the temperature change amount of the coolant to the difference between the peak temperature and the temperature of the coolant in the case where the temperature of the coolant is changed is large. In the SI combustion, when the temperature of the coolant is changed, the cooling loss is significantly changed. In the SI combustion, when the temperature of the coolant is changed, the temperature of the exhaust gas is significantly changed.

Thus, in the SI combustion, the correction amount of the temperature of the exhaust gas is increased to be larger than that in the SPCCI combustion. In this way, the correction module 107 can appropriately correct the temperature of the exhaust gas in consideration of the relationship between the combustion mode and the cooling loss.

Referring back to the flowchart in FIG. 7, in step S7, the correction module 107 corrects the temperature of the exhaust gas according to the correction amount 1201 corresponding to the SI combustion. In step S10, the correction module 107 corrects the temperature of the exhaust gas according to the correction amount 1202 corresponding to the case where the air-fuel ratio of the air-fuel mixture is the stoichiometric air-fuel ratio in the SPCCI combustion. In step S12, the correction module 107 corrects the temperature of the exhaust gas according to the correction amount 1203 corresponding to the case where the air-fuel ratio of the air-fuel mixture is lean in the SPCCI combustion.

By the procedure that has been described so far, the ECU 10 that has estimated the temperature of the exhaust gas executes the control to reduce the temperature of the exhaust gas in the case where the estimated temperature of the exhaust gas is higher than the reference temperature. The ECU 10 increases the amount of the fuel supplied to the cylinder to be larger than that when the temperature of the exhaust gas is equal to or lower than the reference temperature, for example. When the amount of the fuel supplied to the cylinder is increased, due to latent heat of the fuel, the amount of which is increased, the temperature of the exhaust gas discharged from the cylinder is reduced. By reducing the temperature of the exhaust gas to be lower than the reference temperature, it is possible to secure reliability of the catalyst provided in the exhaust passage 50 of the engine 1.

The ECU 10 may reduce the temperature of the coolant supplied to the engine 1 to be lower than that in the case where the temperature of the exhaust gas is equal to or lower than the reference temperature. More specifically, the ECU 10 controls the thermostat valve 76 and the flow rate regulator valve 77 in the cooling system 70 so as to regulate the temperature of the coolant supplied to the engine 1. In this way, the cooling loss of the engine 1 can be regulated, and it is possible to reduce the temperature of the exhaust gas that is discharged from the cylinder.

The ECU 10 may further increase the flow rate of the coolant supplied to the engine 1 to be higher than that of the case where the temperature of the exhaust gas is equal to or lower than the reference temperature. More specifically, the ECU 10 controls the thermostat valve 76 and the flow rate regulator valve 77 in the cooling system 70 to regulate the flow rate of the coolant supplied to the engine 1. In this way, the cooling loss of the engine can be regulated, and it is possible to reduce the temperature of the exhaust gas that is discharged from the cylinder.

The above-described control for reducing the temperature of the exhaust gas can be combined.

In the configuration example, the ECU 10 uses the models, each of which represents the relationship between the progress of the combustion and the temperature of the exhaust gas, to estimate the temperature of the exhaust gas, and corrects the estimated temperature of the exhaust gas according to the temperature of the engine 1. Differing from the above, a model that represents a relationship among the progress of the combustion, the temperature of the exhaust gas, and the temperature of the engine may be created. Then, the ECU 10 may use such a model to estimate the temperature of the exhaust gas from the progress of the combustion and the temperature of the engine. This configuration corresponds to a configuration in which the correction module 107 is provided in the estimation module 106.

The ECU 10 may estimate the temperature of the exhaust gas by using a map that at least represents the relationship between the progress of the combustion and the temperature of the exhaust gas instead of the model that represents the relationship between the progress of the combustion and the temperature of the exhaust gas.

The technique disclosed herein is not limited to the technique applied to the engine 1 having the above-described configuration. Any of various configurations can be adopted as the configuration of the engine 1. For example, the technique disclosed herein may be applied to a diesel engine in which the in-cylinder air-fuel mixture is not forcibly ignited. Also, with the diesel engine, the control unit can accurately estimate the temperature of the exhaust gas from the model, which represents the relationship between the progress of the combustion and the temperature of the exhaust gas, and the progress of the combustion.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1: Engine
10: ECU (control unit)
105: Calculation module
106: Estimation module
50: Exhaust passage
801, 802, 803: Model
901, 902, 903, 904: Model
1001, 1002, 1003, 1004: Model
SW6: In-cylinder pressure sensor
SW11: Crank angle sensor

The invention claimed is:

1. An engine controller for an engine, the engine controller comprising:

an exhaust passage which is connected to the engine and through which exhaust gas is discharged from inside of a cylinder of the engine;

a sensor which outputs a signal corresponding to a combustion state in the cylinder; and a control unit to which the sensor is connected, which estimates a temperature of the exhaust gas on the basis of the signal of the sensor, and which controls the engine according to the estimated temperature of the exhaust gas, wherein the control unit changes an air-fuel ratio of an air-fuel mixture in the cylinder to a stoichiometric air-fuel ratio or a leaner air-fuel ratio than the stoichiometric air-fuel ratio according to an operation state of the engine, the control unit includes a processor configured to execute:

a calculation module that calculates progress of combustion as a crank angle at the time when the combustion in the cylinder is progressed to a particular extent on the basis of the signal of the sensor; and an estimation module that estimates the temperature of the exhaust gas on the basis of the progress of the combustion calculated by the calculation module, the air-fuel ratio of the air-fuel mixture, and a temperature of the engine, and in a case where the air-fuel ratio of the air-fuel mixture is the stoichiometric air-fuel ratio, the estimation module estimates the temperature of the exhaust gas on the basis of the progress of the combustion, the temperature of the engine, and a first relationship that is at least defined between the progress of the combustion and the temperature of the exhaust gas, and in a case where the air-fuel ratio of the air-fuel mixture is leaner than the stoichiometric air-fuel ratio, the estimation module estimates the temperature of the exhaust gas on the basis of the progress of the combustion, the temperature of the engine, and a second relationship that differs from the first relationship and is at least defined between the progress of the combustion and the temperature of the exhaust gas.

2. The engine controller according to claim 1, wherein the estimation module estimates the temperature of the exhaust gas from the progress of the combustion on the basis of a relationship including the first relationship or the second relationship, and corrects the estimated temperature of the exhaust gas according to the temperature of the engine, and the estimation module changes a correction amount of the temperature of the exhaust gas according to the air-fuel ratio of the air-fuel mixture.

3. The engine controller according to claim 2, wherein in the case where the air-fuel ratio of the air-fuel mixture is the stoichiometric air-fuel ratio, the estimation module increases the correction amount of the temperature of the exhaust gas to be larger than in the case where the air-fuel ratio of the air-fuel mixture is leaner than the stoichiometric air-fuel ratio.

4. The engine controller according to claim 2, wherein the estimation module makes a correction to reduce the estimated temperature of the exhaust gas as the temperature of the engine is reduced in a case where the temperature of the engine is equal to or lower than a specified temperature, and makes a correction to increase the estimated temperature of the exhaust gas as the temperature of the engine is increased in a case where the temperature of the engine exceeds the specified temperature.

5. The engine controller according to claim 1, wherein the control unit switches between a first combustion mode, in which the air-fuel mixture in the cylinder is forcibly ignited according to the operation state of the engine, so as to burn the air-fuel mixture by flame propagation, and a second combustion mode, in which the air-fuel mixture in the cylinder is forcibly ignited, so as to burn some of the air-fuel mixture by self-ignition, and in the second combustion mode, the control unit changes the air-fuel ratio of the air-fuel mixture according to the operation state of the engine.

6. The engine controller according to claim 1, wherein in a case where the temperature of the exhaust gas is higher than a reference temperature, the control unit increases a fuel amount supplied to the cylinder to be larger than in a case where the temperature of the exhaust gas is equal to or lower than the reference temperature.

7. The engine controller according to claim 1, wherein in a case where the temperature of the exhaust gas is higher than a reference temperature, the control unit reduces a temperature of a coolant supplied to the engine to be lower than in a case where the temperature of the exhaust gas is equal to or lower than the reference temperature.

8. The engine controller according to claim 1, wherein in a case where the temperature of the exhaust gas is higher than a reference temperature, the control unit increases a flow rate of the coolant supplied to the engine to be larger than a case where the temperature of the exhaust gas is equal to or lower than the reference temperature.

* * * * *